US005795250A

United States Patent [19]

Cripe

[11] Patent Number: 5,795,250

[45] Date of Patent: Aug. 18, 1998

[54] TETHERED BALL PRACTICE DEVICE

[76] Inventor: Larry Duane Cripe, 14946 18th Ave. SW., Seattle, Wash. 98166

[21] Appl. No.: 742,380

[22] Filed: Nov. 1, 1996

[51] Int. Cl.[6] ..... A63B 69/00

[52] U.S. Cl. ..... 473/426

[58] Field of Search ..... 473/421, 426, 473/428, 431, 439, 418, 429, 430, 423

[56] References Cited

U.S. PATENT DOCUMENTS

| | | | |
|---|---|---|---|
| 849,941 | 4/1907 | Titus | 473/421 |
| 1,554,409 | 9/1925 | Coffee | 473/426 |
| 1,591,753 | 7/1926 | Flaugh | 473/421 |
| 2,292,109 | 8/1942 | Engel | 473/421 |
| 2,839,300 | 6/1958 | Blaha | 473/430 |
| 3,408,071 | 10/1968 | Lundy | 473/421 |
| 3,717,343 | 2/1973 | Henry | 473/423 |
| 4,161,313 | 7/1979 | Dickey | 473/423 |
| 4,867,448 | 9/1989 | Judd | 473/426 |
| 5,040,791 | 8/1991 | Ratajac | 473/426 |
| 5,056,781 | 10/1991 | Preston | 473/430 |
| 5,386,986 | 2/1995 | Gamboa | 473/30 |
| 5,407,211 | 4/1995 | Bottiglieri | 473/421 |
| 5,419,550 | 5/1995 | Blom | 473/426 |
| 5,458,326 | 10/1995 | Marcyes | 473/426 |
| 5,460,364 | 10/1995 | Ring | 473/430 |

*Primary Examiner*—Theatrice Brown

*Attorney, Agent, or Firm*—Hughes, Multer & Schacht, P.S.

[57] ABSTRACT

A practice device for improving batting, pitching, and fielding skills. The device includes a backstop which can be adjusted at different angles to the vertical to return balls striking the backstop on the ground or in the air. With the device configured for batting practice, a ball is positioned at a selected height above and at a selected location across the span of a home plate by a suspension system which includes a cantilevered arm fixed to the backstop, a tether, and a motion damping arrangement which almost instantaneously brings the tethered ball to rest after the ball is struck and rebounds to its rest position. The components of the practice device can be and quickly folded or otherwise positioned against the backstop to provide a compact, easily stored package. The practice device can also be easily configured as a wheeled cart easily moved from one location to another along with ball bags and other equipment stowable on the cart.

16 Claims, 16 Drawing Sheets

TETHERED BALL PRACTICE DEVICE

CROSS REFERENCE TO ANOTHER APPLICATION

The present application is copending with and is entitled to the benefit of the filing date of provisional application no. 60/006,166 filed Nov. 2, 1995 and also entitled PRACTICE DEVICE.

TECHNICAL FIELD OF THE INVENTION

The present invention relates to a novel, improved device for improving batting, pitching, and fielding skills.

BACKGROUND OF THE INVENTION

As in many other endeavors, practice is the activity which a ball player can most profitably utilize to improve his or her game. Thus, batting practice can be utilized to enable one to hit the ball more effectively; practice can also be counted on to improve a pitcher's control and delivery and a player's ability to field a ball.

Live practice is effective. However, it has the disadvantage that a number of players in addition to the one who is practicing are required. A batter, for example, must be supported by a pitcher, a catcher, and fielders. Consequently, for an entire team to take batting practice involves an investment in time and manpower which may make it impractical at best for a player to take extra practice or to practice when other players are not available. Live practice is also constrictive in that a playing field is required.

This has not surprisingly resulted in a number of practice devices being proposed and disclosed in: U.S. Pat. Nos. 5,040,791 to Ratajac et al.; 708,573 to Miles; 1,554,409 to Coffee; and 5,340,101 to Lawson et al. and in a brochure made available by Sports Lab USA and entitled SOLOHITTER. Typically, these heretofore proposed practice devices are heavy and bulky and present problems in storage and in moving them from place-to-place. Furthermore, prior art devices allow one to practice only a single skill. For example, Sports Lab USA supplies separate products for practicing fielding and batting.

Another common drawback of those products heretofore designed for batting practice is that a struck ball oscillates for a considerable period of time after being struck before coming to rest in its original position. This is both distracting to the batter and time consuming.

Heretofore proposed products designed for batting practice also commonly have the disadvantage that no provision is made for adjusting the baseball or softball component of the device so that, for example, low, high, inside, and outside pitches can be emulated. Thus, the use of such a device to practice batting is of questionable value.

SUMMARY OF THE INVENTION

There have now been invented, and disclosed here, certain new and novel practice devices which do not have the disadvantages discussed above and which are otherwise superior to those practice devices heretofore proposed.

These novel practice devices have the advantage that they can be readily configured for batting or pitching or fielding practice, thereby eliminating the need of a separate device for practicing each of these skills. Also, in this respect, the devices of the present invention have a novel backstop and strut arrangement which allows the inclination of the backstop to be adjusted so that balls striking the backstop net will rebound as ground balls or in the air as the user prefers.

The ball-suspension systems of practice devices employing the present invention are of perhaps particular significance. A pivotable suspension arm allows a tethered practice ball to be displaced from side-to-side of a home plate incorporated in the device and thereby emulate inside and outside pitches as well as pitches which are down the middle of the plate. Associated with the suspension arm are a motion damping system to which the ball is coupled and a tether coupled to the motion damping system below the ball. Struck balls rapidly return to their nominal or rest position. The damping system almost instantaneously dissipates oscillations and other movements of the ball encountered when the ball is halted at the rest position by the tether. Consequently, the ball is motionless and can be struck again as soon as the batter is ready; the batter need not wait for the ball to come to rest. Also, the damping arrangement is so designed that the height of the rest position can quickly be adjusted to emulate pitches which are high, low, etc.

Another extremely important advantage of practice devices embodying the principles of the present invention is that they are collapsible into a compact package and can be stored in considerably less space than the Sports Lab USA and other heretofore proposed, rigid frame devices.

Another important feature of practice devices embodying the principles of the present invention is that they can be reconfigured into a cartlike configuration and are provided with wheels which can concurrently be lowered to roll the practice device from place-to-place. A surface-engaging support for the backstop unit of the device in that case serves as a cart handle. Also, in this configuration, the backstop unit (at this point folded) provides a platform on which bats, ball bags, and other equipment can be loaded. That considerably simplifies the task of transporting equipment from one location to another. By later returning the wheels to the out-of-the-way locations they occupy when the device is in use, the cart configured device can again be stored in a small space.

The practice device can be easily and quickly erected from either of the two alternate configurations just discussed and can be broken down into those configurations with equal facility. Furthermore, only one person is needed to erect and break down the device.

Practice devices embodying the principles of the present invention also have the advantages of being rugged and durable. To a considerable extent, off-the-shelf tubing and components are employed. This is a particular advantage from the viewpoint of manufacturing costs.

DETAILED DESCRIPTION OF THE INVENTION

Figure 1:
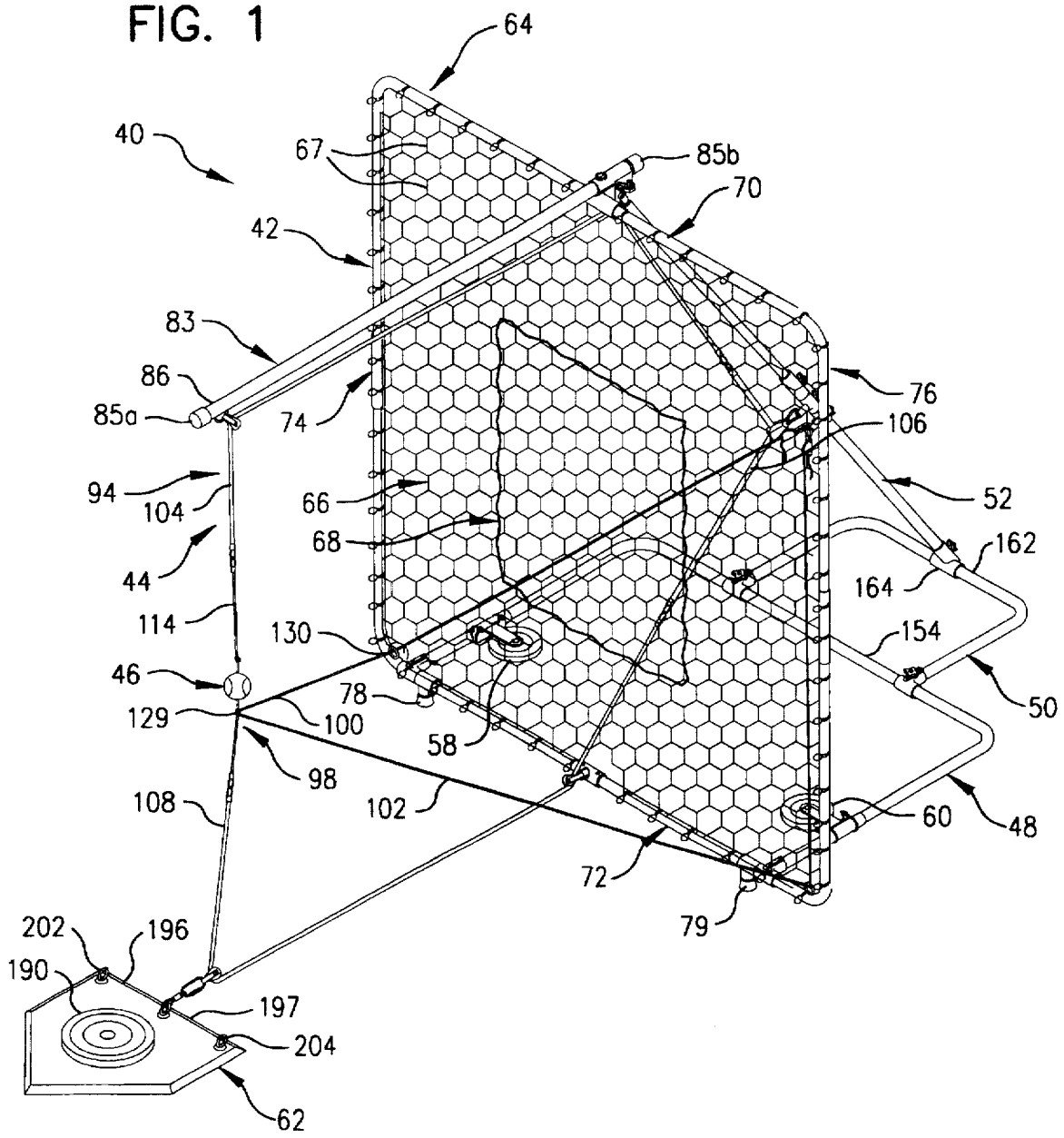
FIG. 1 is a perspective view of a practice device employing and embodying the principles of the present invention; the practice device includes a backstop with a resiliently displaceable net and a component for outlining a strike zone at a selected location on the net, and the practice device is shown erected and configured for batting practice.

The practice device shown in FIGS. 1–26 of the drawings is identified in FIGS. 1–4 by reference character 40. The major components of the practice device are a backstop unit 42; a suspension system 44 for a ball 46; and U-shaped, surface-engaging components 48 and 50. Components 48 and 50 cooperate with a telescopable strut 52 to maintain backstop unit 42 in an erect position which may vary between the limits identified by reference characters 54 and 56 in FIG. 26 as suggested by arrows 57*a* and 57*b*. Practice device 40 also has wheels 58 and 60 which can be lowered to roll the device from place-to-place and a home plate 62.

Backstop unit 42 includes a rectangular frame 64, a net 66, composed of filaments 67, and a cord 68 which can be threaded into net 66 at a location selected by a user to outline a strike zone.

Backstop frame 64 has top and bottom rails 70 and 72 and side rails 74 and 76. Supporting feet 78 and 79 are fixed to bottom rail 72 at opposite ends of that rail. Backstop frame side rails 74 and 76 each have two sections (74*a* and 74*b* and 76*a* and 76*b*) which are held in longitudinally aligned, end-to-end relationship by a sleeve 80 (see FIG. 8) when practice device 40 is set up for batting, fielding, or pitching practice. Sliding sleeve 80 in the arrow 81 direction (FIG. 7) allows the side rails to be disjointed and backstop unit 42 folded in two in the course of the converting the practice device to the cart configuration of FIG. 23. Bungee cord connector systems 82 keep the sections (74*a*/74*b* and 76*a*/76*b*) from becoming totally separated and making the backstop unit hard to handle.

Net 66 is open mesh construction. Its filaments 67 are fabricated of resilient material so that balls striking the net will bounce back toward one using practice device 40.

Figure 9:
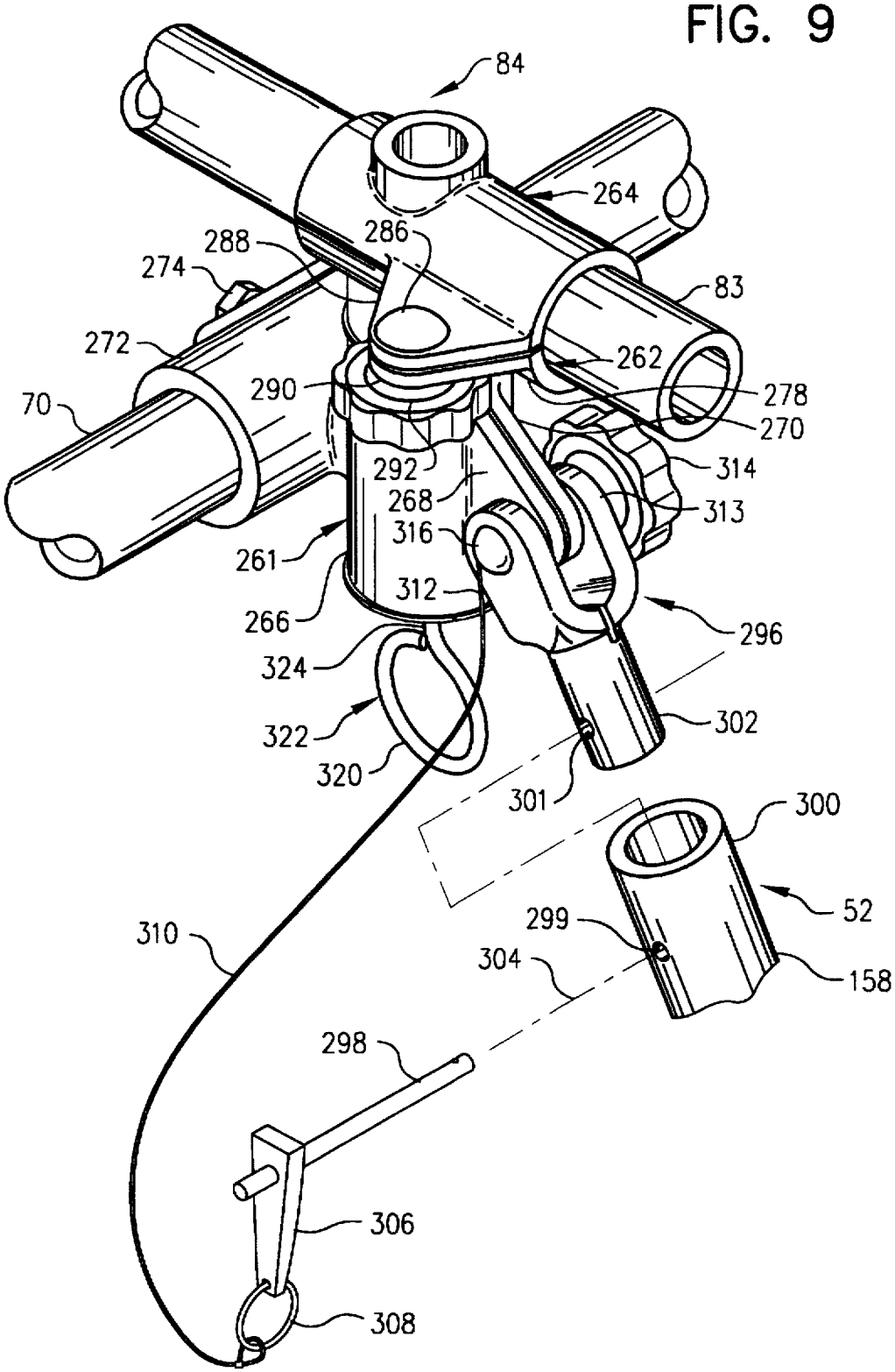
FIG. 9 is a perspective view of a fitting which is installed on a horizontal frame member at the upper margin of the practice device backstop unit; this fitting allows the ball-supporting, cantilevered arm to be pivoted horizontally as shown in FIG. 4 for the purposes discussed in the description of that figure and to also be pivoted vertically to adjust the height of the ball above home plate.
Figure 10:
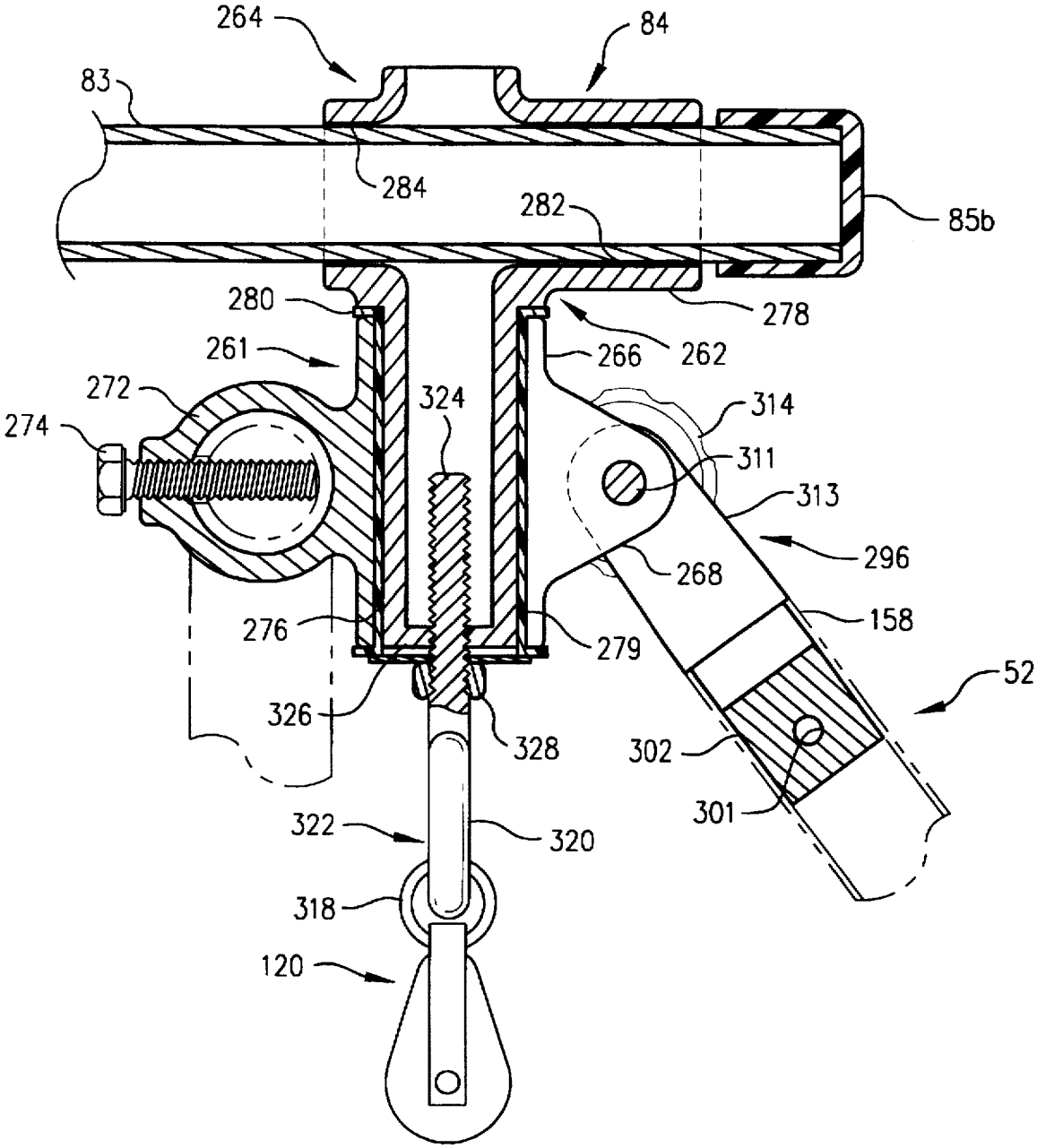
FIG. 10 is a vertical section through the upper, horizontal member of the backstop unit framework and the FIG. 9 fitting installed on that member.
Figure 11:
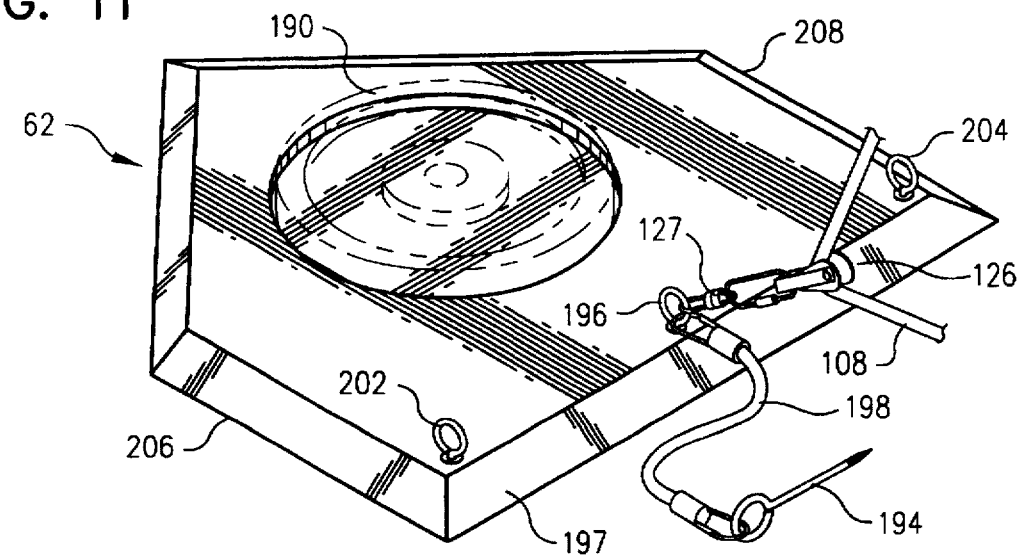
FIG. 11 is a perspective view of the home plate unit employed in the FIG. 1 practice device.

The ball-suspension system 44 utilized when device 40 is configured for batting practice includes an elongated, cantilevered arm 83 extending at normally from and supported at one end from the top rail 70 of backstop frame 64 in the fitting shown in detail in FIGS. 9 and 10 and identified by reference character 84. This fitting allows the opposite, free end 86 of the arm to be swung horizontally as indicated by arrow 90 in FIG. 4. As a consequence, ball 46 can be moved from side-to-side of home plate 62 as shown in the same figure. Thus, ball 46 can be readily positioned to emulate inside and outside pitches and pitches which cross the center of home plate 62. Also, fitting 84 allows arm 83 to be swung to an out-of-the-way position for storage and transportation of practice device 40 (see FIG. 15).

Caps 85*a* and 85*b* on the opposite ends of arm 83 keep one from perhaps being injured by sharp edges at the ends of the arm.

Figure 2:
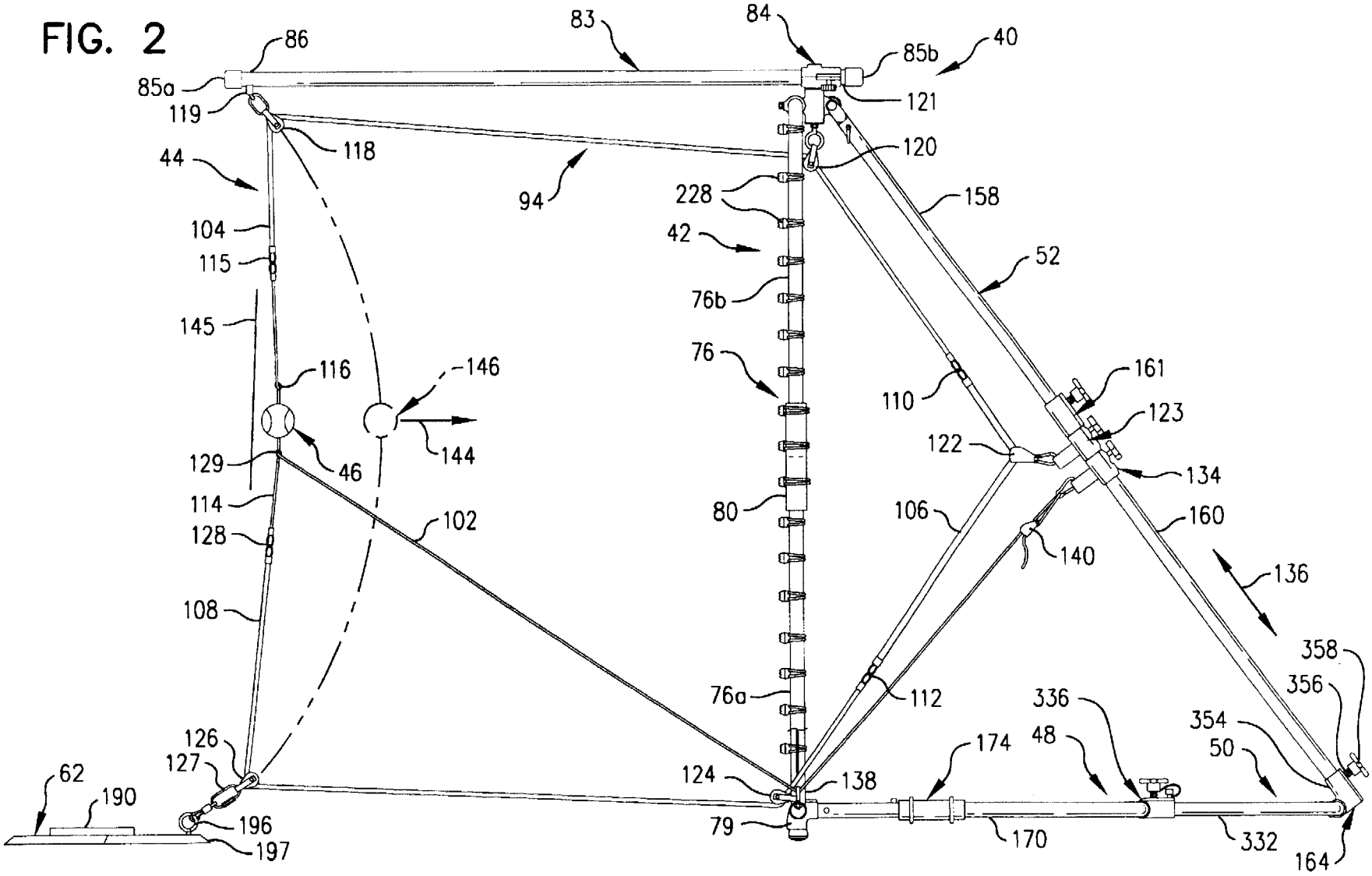
FIG. 2 is a side view of the practice device.
Figure 3:
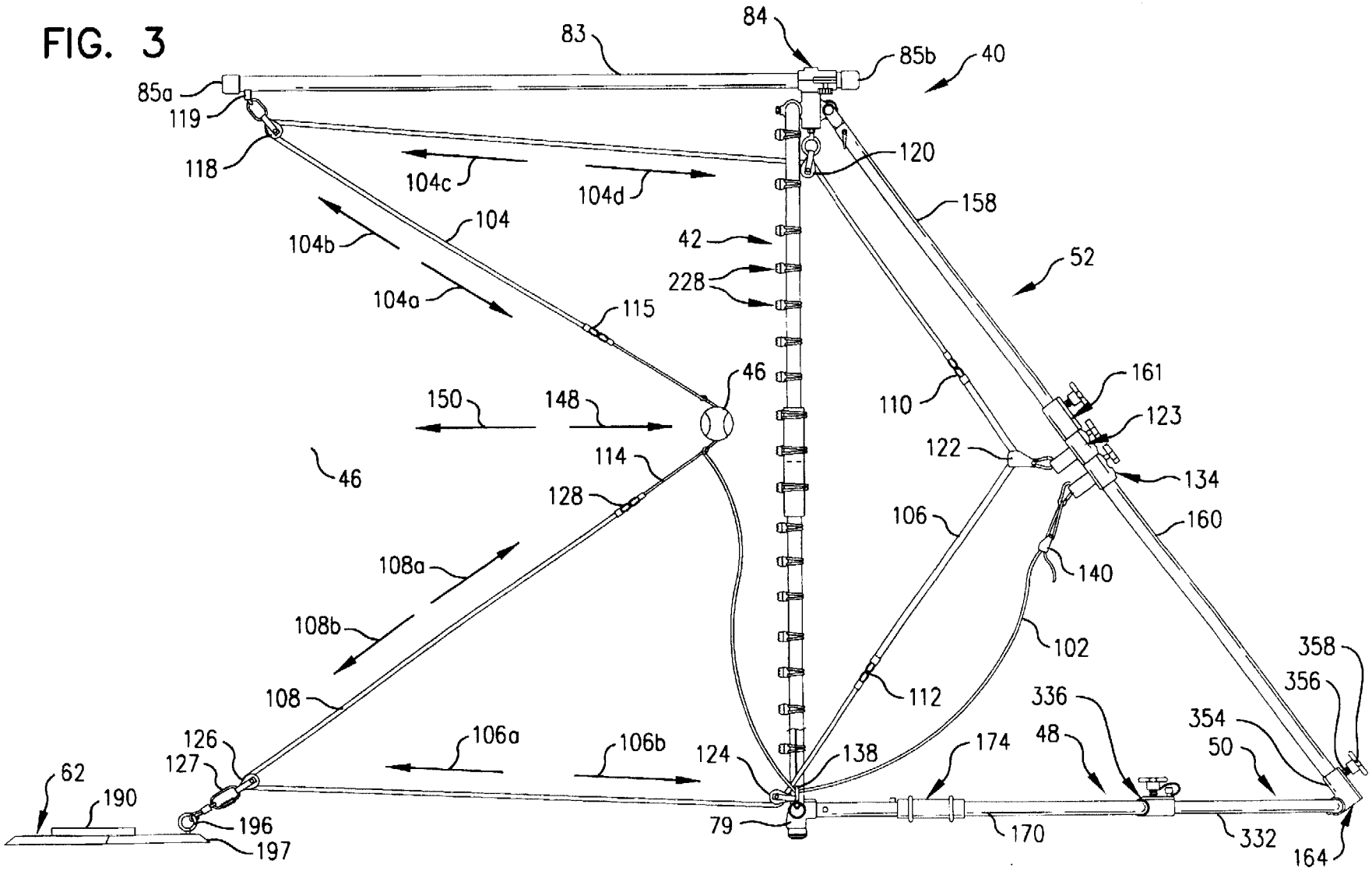
FIG. 3 is a view similar to FIG. 2 but with a game ball component of the practice device displaced by a bat-generated impact and with elastically extensible cords of a ball-supporting system stretched and thereby possessed of potential energy for immediately thereafter restoring the ball to the at rest location shown FIG. 2.

Ball-suspension system 44 also includes an elastic damping unit 94 and a tether 98 composed of two inextensible cords 100 and 102. In the exemplary practice device 40 shown in the drawings, damping unit 94 of suspension system 44 is composed of three bungee cords 104, 106, and 108 joined in end-to-end relationship by connectors or couplings 110 and 112. An inelastic cord 114 is strung through ball 46 and immobilized along the cord between two knots, one above and one below the ball. The upper knot is shown in FIGS. 1–3 and identified by reference character 116.

One end of bungee cord 104 is fixed to the upper end of cord 114 by connector 115. From there, the bungee cord is trained through a pulley 118 suspended from cantilevered arm 83 near the free end 86 of that component by an eye bolt 119 and through a second pulley 120 suspended from arm 83 at the opposite, frame-associated end 121 of the arm. The second bungee cord 106 extends from connector 110 through a pulley 122 suspended from telescopable, backstop unit supporting strut 52 intermediate the upper and lower ends of that component. Pulley 122 is attached to a fitting 123 which is mounted on and slidable along telescopable strut 52. The third bungee cord 108 extends from connector 112 through: (1) a pulley 124 suspended from the bottom rail 72 of backstop frame 64, and (2) a pulley 126 suspended from home plate 62 by a quick release fitting 127 (see FIG. 11) to (3) a connector 128 which couples bungee cord 108 to the lower end of ball-supporting cord 114.

Figure 4:
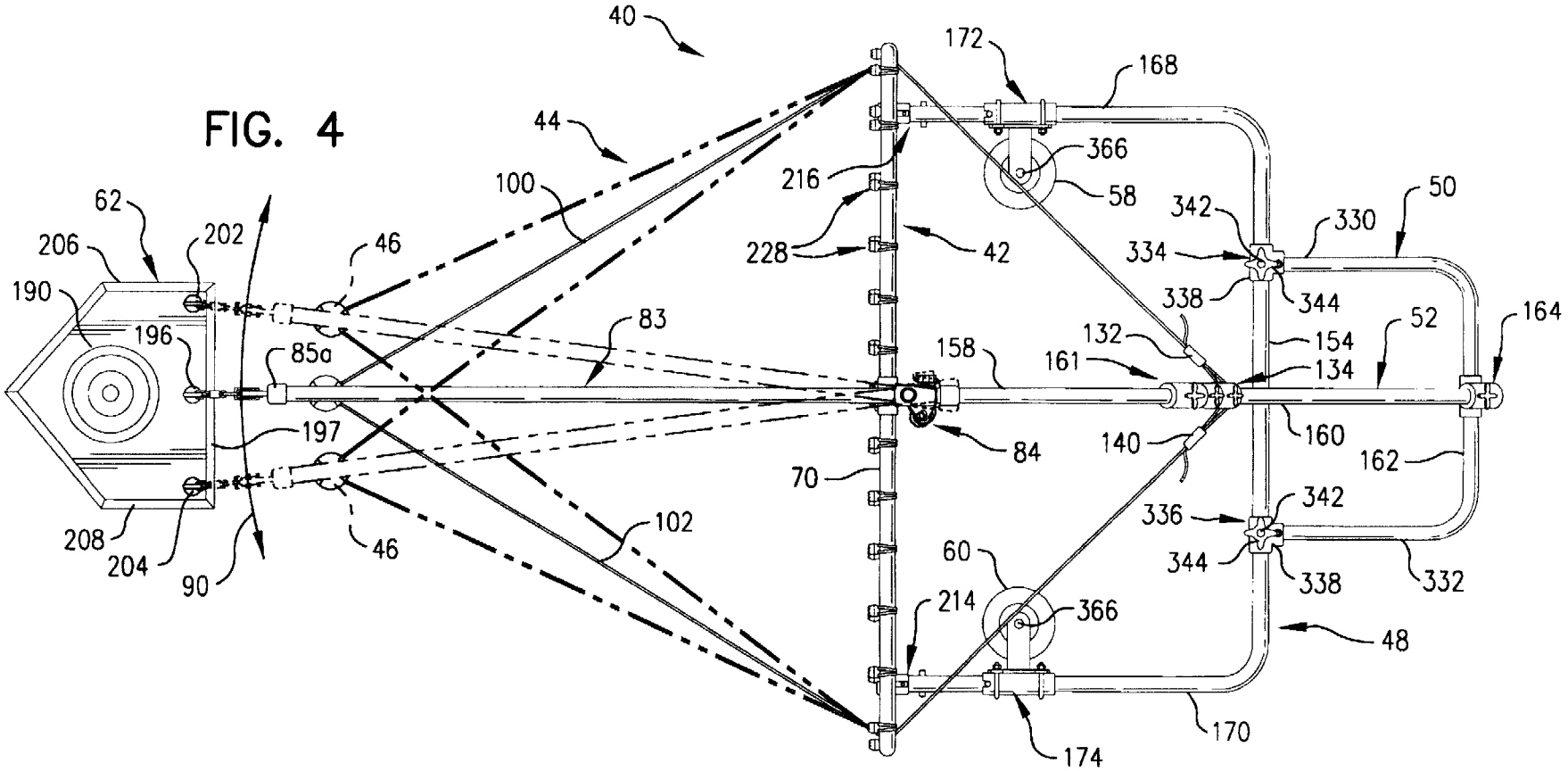
FIG. 4 is a top view of the FIG. 1 practice device showing how a cantilever-mounted arm which is located at the top of the device can be pivoted to move the ball to locations emulating inside and outside pitches as well as pitches over other parts of the home plate shown in FIG. 4; the arm is part of the ball-suspension system which also includes the inextensible and elastically extensible cords shown in FIGS. 1–3.

As is best shown in FIG. 4, the two cords 100 and 102 of tether 98 are tied at one end, and at the same location 129 beneath ball 46, to the ball-supporting cord 114. From there, tether component 100 is trained through the eye of an eye bolt 130 at the lower end of backstop frame side rail 74 and then through a ratchet-type keeper or latch 132. Latch 132 is best shown in FIG. 4 and is suspended from telescopable strut 52 toward the lower end of that component by a fitting 134 which is adjustable along the strut as indicated by arrow 136 in FIG. 2. The second of the tether cords 102 similarly extends from the location 129 where it is tied to cord 114 beneath ball 46 through the eye of an eye bolt 138 at the opposite side of backstop frame 64 and toward the lower end of side rail 76 and then through a second ratchet-type latch 140 also suspended from fitting 134 (see FIG. 4).

Fitting 123 is adjusted along strut 52 to raise and lower ball 46, thus emulating high and low pitches. Displaceable fitting 134 can at the same time be moved along strut 52 as necessary to accommodate the ball height-adjusting displacement of fitting 123.

Tether components 100 and 102 are tightened to slightly tension the cords of damping system 94 by pulling equally on ball 46 to displace it in the arrow 144 direction (see FIG. 2.) from a straight line 145 extending between bungee cord-supporting pulleys 118 and 126. The represented displacement of ball 46 in FIG. 1 closely approximates the displacement actually-employed in setting up practice device 40 for batting practice. Greater displacement, for example to the position identified by reference character 146 in FIG. 2 with the consequent, illustrated bowing of bungee cords 104 and 108 and ball-supporting line 114 would place too much tension on the bungee cord; and the practice device would not function properly; i.e., it would not rapidly damp movements of ball 46 as the ball returns to its rest position after being struck.

Turning now to FIG. 3, the impact of a bat drives ball 46 toward backstop unit 42 as suggested by arrow 148. This stretches and displaces the elastic bungee cords 104, 106, and 108 of damping system 94 as shown by arrows 104*a*, 104*c*, 106*a*, and 108*a*, storing potential energy in those segments; and the cords 100 and 102 of tether 98 becomes slack. Next, as the ball reaches the end of its movement toward net 66, the stored potential energy is converted to kinetic energy which returns ball 46 to the rest position shown in FIGS. 1 and 2 as indicated by arrow 150 in FIG. 3. Damping system bungee cords 104, 106, and 108 contract to their original lengths and return to their at rest positions with the motions of the cords being indicated by arrows 104*b*, 104*d*, 106*b*, and 108*b* as this occurs.

As ball 46 reaches the rest position, inelastic tether lines 100 and 102 become taut and keep ball 46 from traveling in the arrow 150 direction beyond that position. With the tether tied to ball-supporting cord 114 beneath ball 46 and with damping system 94 tensioned to the extent just described, system 94 efficiently damps the oscillations of ball 46 as its supporting line 114 is brought to an abrupt halt by tether 98. As a consequence, ball 46 is almost immediately restored to and made motionless in the rest position after being struck. This is a highly desirable feature of the present invention as rigged for batting practice because the batter does not have to wait for the ball to quit moving (a common failing of heretofore proposed batting practice devices) before striking the ball again.

Figure 26:
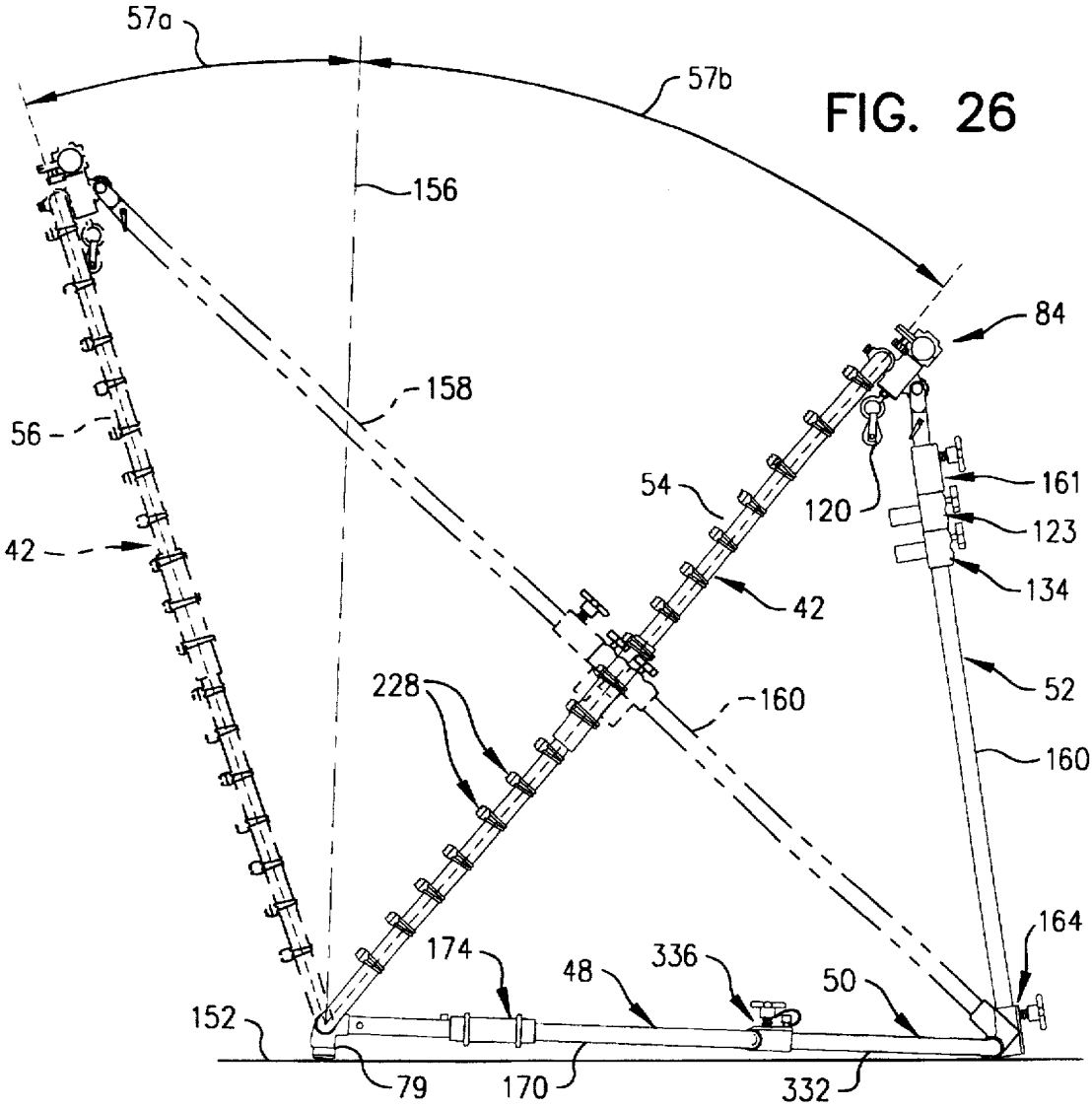
FIG. 26 is a side view of the FIG. 1 practice device erected but with the cantilevered, ball-supporting arm in the stowed position of FIG. 17 and the remainder of the ball-suspension system out-of-the-way so that the device can be employed for pitching and/or fielding practice; this figure also shows how extension and retraction of the collapsible, backstop-supporting strut can be employed to adjust the angle of the backstop so that a ball thrown against the backstop net will be returned as a ground ball or an air ball.
Figure 12:
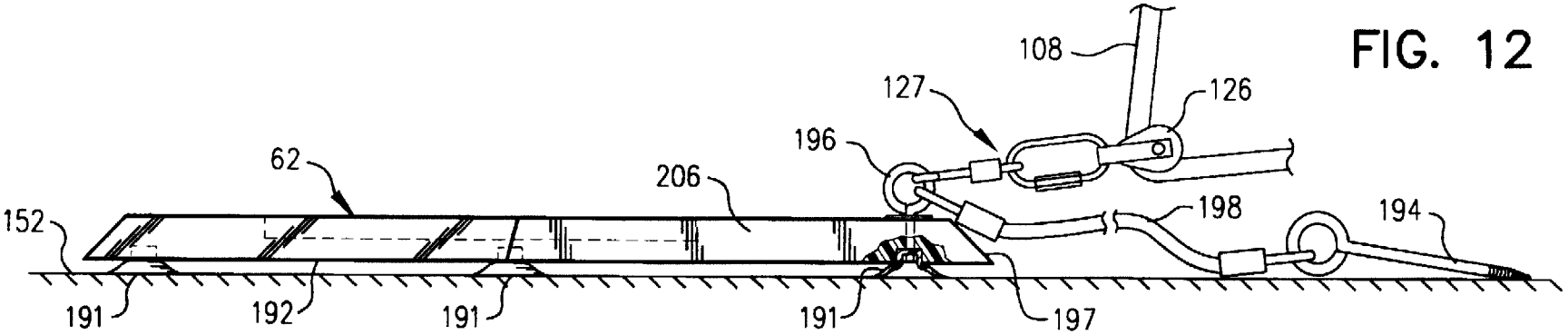
FIG. 12 is a side view of the home plate unit fixed by suction cups to a smooth supporting surface such as a gymnasium floor.

As is best shown in FIGS. 1 and 4, and as can be appreciated from FIG. 26, backstop unit 42 is supported from the playing surface (identified by reference character 152 in FIG. 26) by feet 78 and 79 and by U-shaped supports 48 and 50 irrespective of whether the practice device 40 is rigged for batting practice, pitching practice, or fielding practice. The feet keep the practice device from scratching a gymnasium floor (or similar surface) on which it may be placed.

Component 48 is pivotally connected to the bottom rail 72 of backstop frame 64; and the second U-shaped support component 50 is pivotally mounted to the transverse leg 154 of component 48. Consequently, the two U-shaped members can be folded against each other and against backstop unit 42 to configure practice device 40 for storage (see FIGS. 16–19) or into a cartlike arrangement so that the practice device can be rolled from one to location to another (see FIGS. 20–24). The pivotal connection between components 48 and 50 also allows ground-engaging component 50 to be rotated through a small angle relative to component 48, thereby adapting component 50 to serve as a cart handle (see FIGS. 23 and 24).

When practice device.40 is configured and rigged for batting practice, backstop unit 42 is positioned in an upright or vertical orientation as shown in FIGS. 1–3 and as indicated by phantom line 156 in FIG. 26. For pitching and fielding practice, the backstop unit may be tilted forwardly by strut 52 (typically through a maximum arc of 20 degrees as shown in phantom lines in FIG. 26) so that a ball striking backstop net 66 will be returned as a ground ball. Conversely, the backstop unit may be tilted backwardly (typically through a maximum angle of 45 degrees as shown in full lines in FIG. 26) so that a ball striking net 66 will rebound from the net in the air.

The telescopable strut 52 employed to hold backstop unit frame 64 at the wanted angle includes an elongated upper component 158; an elongated, tubular component 160 in which component 158 is slideably mounted; and a tubular clamp 161 supported on lower component 160 for locking the telescoping components 158 and 160 together. Backstop unit 42 is immobilized in the selected orientation between the limits shown in FIG. 26 by adjusting the length of strut 52.

At its upper end, strut 52 is pivotally connected to the upper rail 70 of backstop frame 64 by fitting 84 (see especially FIGS. 9 and 10). The lower end of the strut is pivotally fixed to the transversely extending leg 162 of surface-engaging U-shaped bracket 50 by a T-shaped fitting 164 mounted on that leg. Strut 52 is removably fixed to both of the just-identified fittings so that it can be removed and stowed when practice device 40 is reconfigured as a cart (see FIG. 23). With practice device 40 configured as a cart, backstop unit 42 serves as a deck on which the illustrated equipment bag 165 and other equipment can be loaded.

As discussed above, fitting 84 allows cantilevered arm 83 of ball-suspension system 44 to be rotated in the horizontal direction (see arrow 90 in FIG. 4). Arm 83 can also be slid through that fitting as indicated by arrow 166 in FIG. 16. This is taken advantage of in configuring practice device 40 for storage and as a cart (see FIGS. 16 and 17) so that the arm will lie in the same plane as the backstop unit 42 and will not extend beyond the sides of the backstop unit frame 64 (see FIGS. 16 and 17). Thus, the dimensions of the package into which the erected practice device can be reconfigured are minimized.

Figure 5:
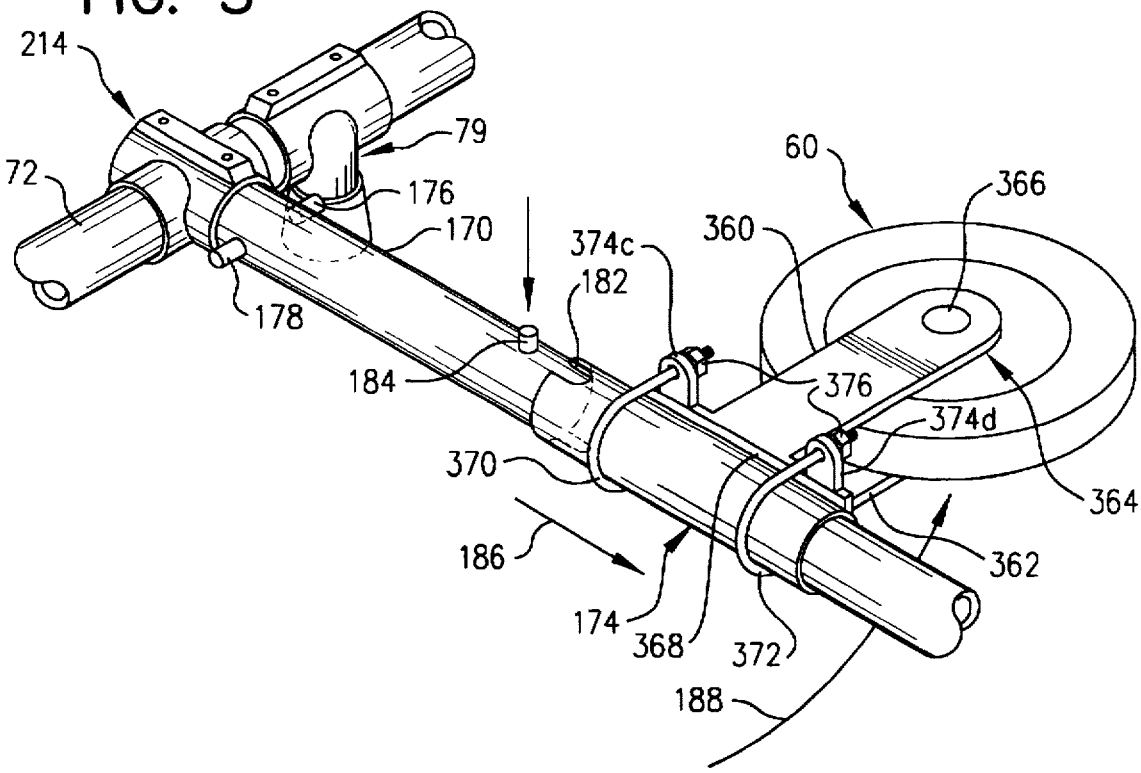
FIG. 5 is a fragmentary view of the FIG. 1 practice device showing: (a) a part of its backstop unit lower frame, (b) one of two wheels located at opposite sides of the device to make the device rollable from place-to-place, and (3) a bracket for supporting the wheel from the backstop unit frame; in this figure, the wheel is shown rotated to a horizontal position to immobilize the practice device on a supporting surface.
Figure 6:
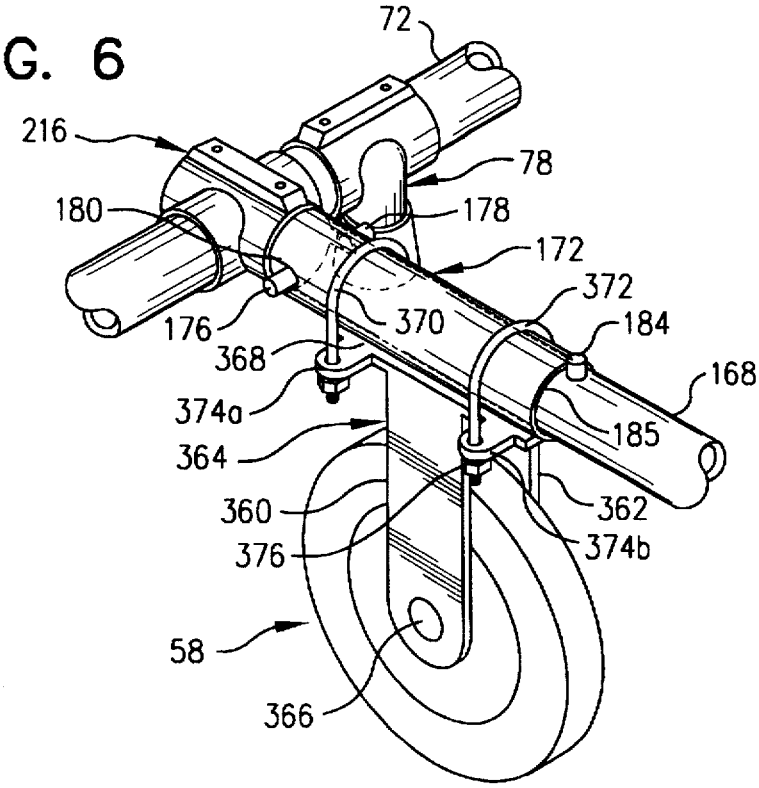
FIG. 6 is a view similar to FIG. 5 but with the mobility-imparting wheel swung downwardly and interposed between the practice device framework and the supporting surface to make the practice device mobile.

The wheels 58 and 60 which allow the reconfigured practice device 40 to be rolled from one location to another are supported from the longitudinally extending legs 168 and 170 of U-shaped support 48 (see FIG. 4) by rotatably displaceable fittings 172 and 174. What happens when each of the wheels 58 and 60 is swung down to make the practice device rollable is the same for both wheels. Consequently, only the operation of wheel 58 is here described. As that wheel reaches the operative, FIG. 6 position, pins 176 and 178 engage slots in fitting 172. These slots are shown in FIGS. 5 and 6 and identified by reference characters 180 and 182. Also, a spring-loaded button 184 engages the end 185 of fitting 172 opposite slots 180 and 182. With pins 176 and 178 engaged in slots 180 and 182 and button 184 engaging fitting end 185, wheel 58 (or 60) is locked in the down, FIG. 6 position.

The depressing of spring-loaded button 184 allows the wheel-supporting fitting (172 or 174) to be slid in the direction indicated by arrow 186 in FIG. 5 until pins 176 and 178 clear slots 180 and 182. The wheel can then be swung upwardly as indicated by arrow 188 in the same figure to raise the wheel 58 or (60) and lower the feet 78 and 79 of practice device 40 to the supporting surface 152 and immobilize that device at the wanted location (see FIG. 1).

Figure 16:
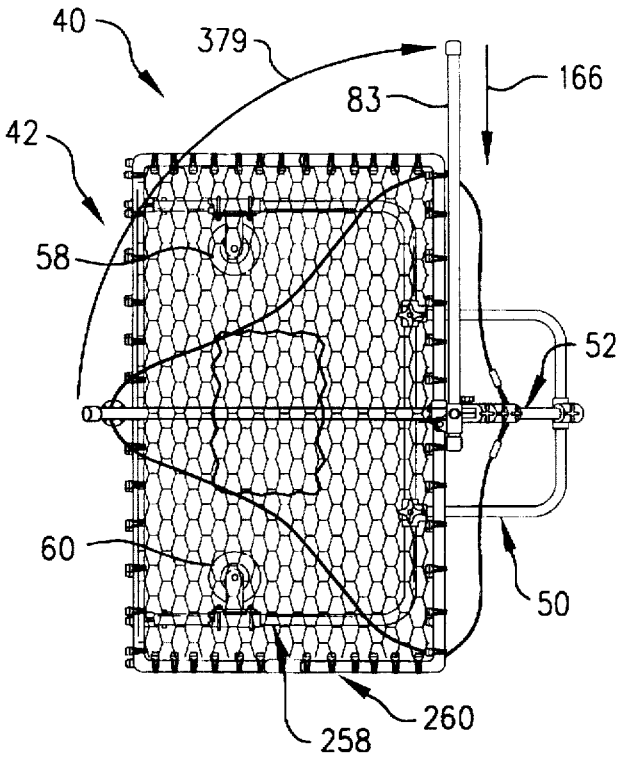
FIG. 16 shows the cantilevered, ball-supporting arm swung from the operative, FIG. 2 position in which the arm extends at right angles to the backstop unit through an arc of 90 degrees against the backstop unit; this is the second step in preparing the practice device for storage.
Figure 18:
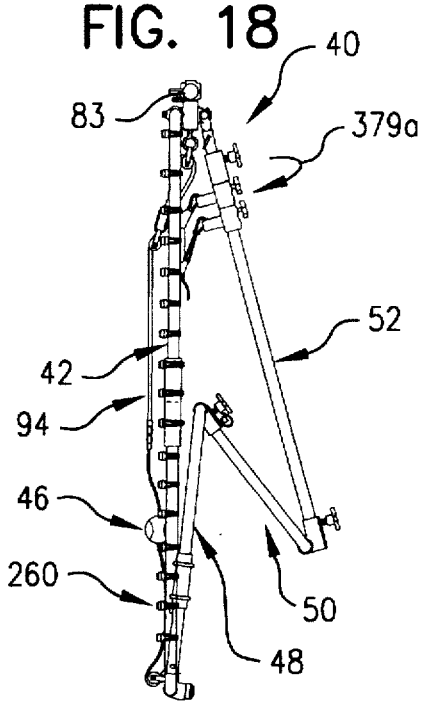
FIG. 18 shows two, U-shaped, surface-engaging supports which hold the backstop unit of the practice device upright in use being collapsed toward each other and against the backstop component; this is the third and final step in folding the practice device to its storage configuration.
Figure 17:
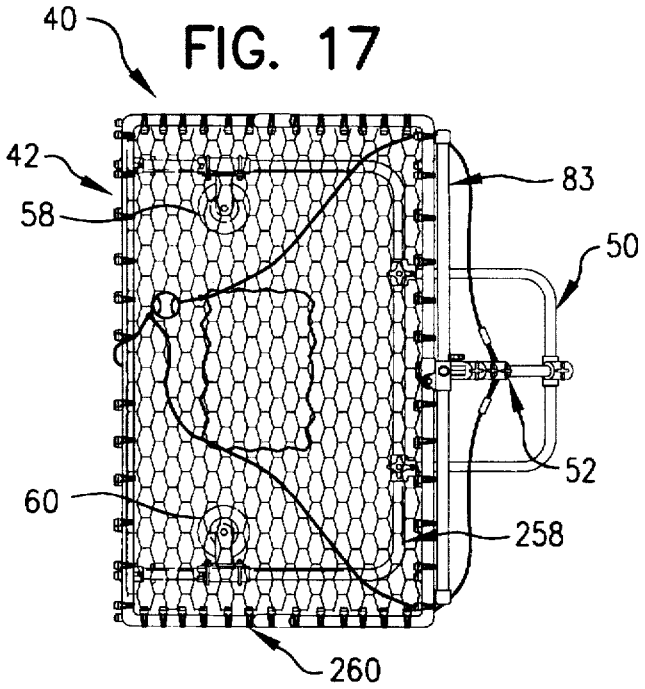
FIG. 17 shows the cantilevered arm displaced longitudinally in the FIG. 10 fitting so that the free end of the arm will not extend beyond the vertical standards of the backstop unit framework.
Figure 25:
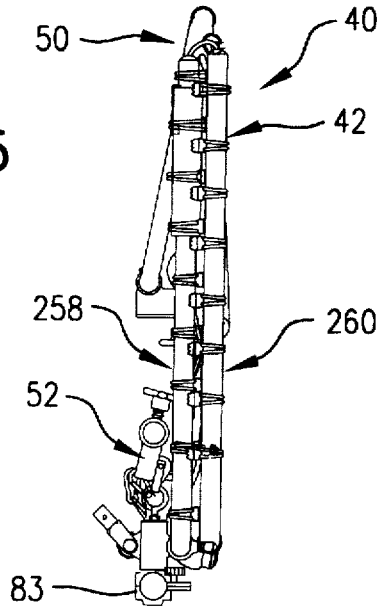
FIG. 25 is a side view of the practice device with the U-shaped, dual-function component folded against the backstop unit and with the wheels of the practice device folded up as shown in FIG. 5 to maximize the compactness of the practice device for storage.

The same displacement from of wheels 58 and 60 from the FIG. 6 position to the FIG. 5 position can also be employed to move the wheels out of the way for the storage of practice device broken down 40. The practice device for storage with wheels 58 and 60 thus configured is shown in FIGS. 16, 17, and 25.

Figure 13:
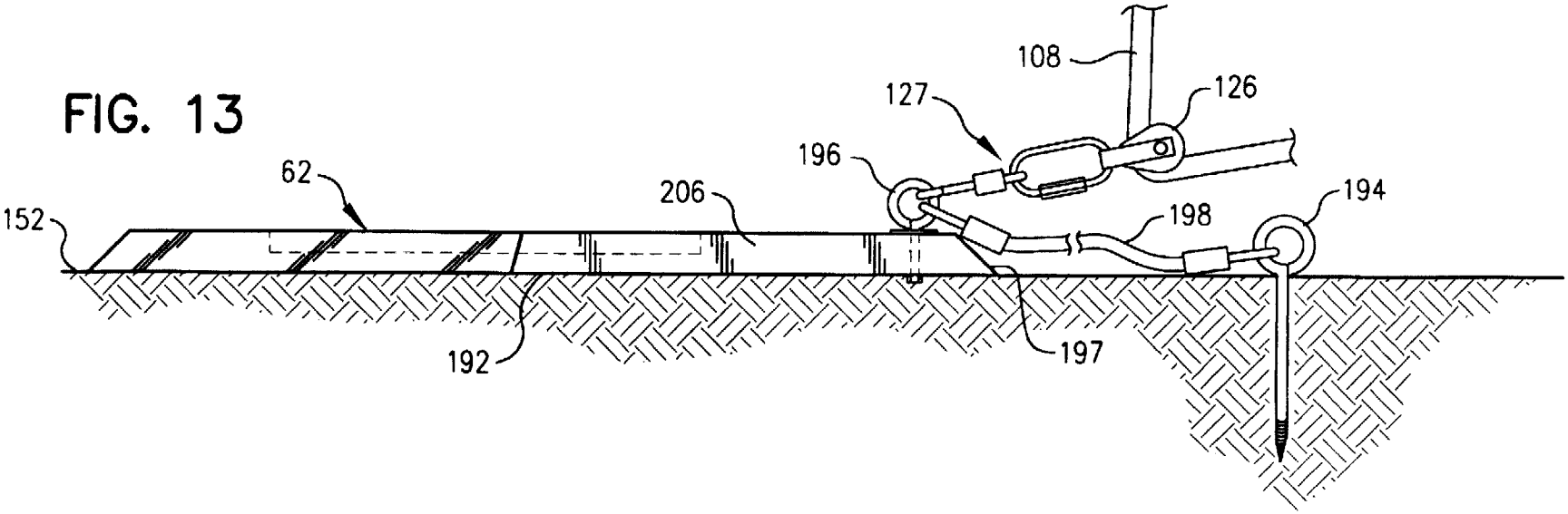
FIG. 13 is a side view of the home plate unit anchored to an earthen playing surface by a spike driven into the ground.
Figure 15:
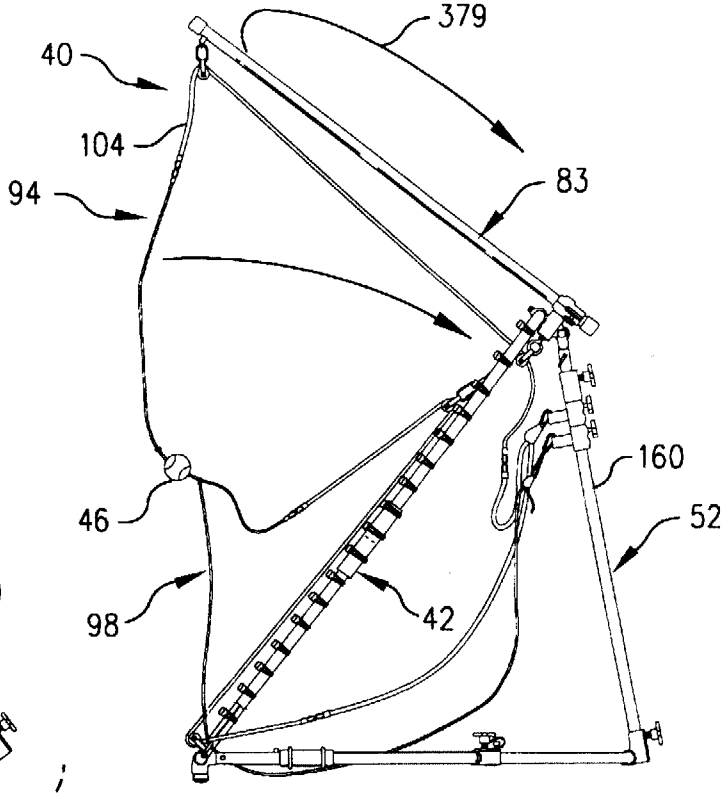
FIGS. 14 and 15 show a telescopable strut which is employed to hold the backstop unit of the FIG. 1 practice device in an erect, operative position (FIG. 14) being collapsed to the minimum length configuration shown in FIG. 15; this is the first step employed in folding the practice device up into a compact, easily storable configuration.

Home plate 62 is of conventional shape and dimensions. The home plate can be anchored to the playing surface by placing a weight 190 on the plate (see FIGS. 1 and 4). If the surface is smooth—for example, a gymnasium floor—suction cups 191 attached to the bottom 192 of the home plate can instead be used to anchor the home plate to supporting surface 152 (see FIG. 12). Also, home plate 62 can be anchored by driving a spike 194 into the ground as shown in FIG. 13. The spike is connected to an eye bolt 196 at the rear edge 197 of home plate 62 by a tether 198.

The eye bolt 196 just described is located both toward the rear edge 197 of home plate 62 and in the center of that practice device component. As is perhaps best shown in FIGS. 1, 4, and 11, two other eye bolts, identified by reference characters 202 and 204, are also located toward the rear edge 197 of home plate 62 but at opposite sides 206 and 208 of the home plate. By coupling damping system fitting 127 to eye bolt 202, ball 46 can be positioned as shown in FIG. 4 to emulate a pitch which is on the inside of the plate to a left-handed hitter. Similarly, by connecting the fitting to the eye bolt 204 at the opposite side 208 of home plate 62, ball 46 can be positioned to emulate a ball which is on the outside of the plate to the left-handed batter.

As indicated above, practice device 40 can be employed to improve pitching and fielding skills as well as one's batting. When used to practice pitching or fielding, ball-supporting arm 83 is left in the stowed position of FIG. 17 or returned to that position as appropriate; and the assembly of damping system 94, tether 98, and ball 46 is unhooked from home plate 62 (see FIG. 14) and stowed by fixing quick release fitting 123 to backstop unit 42 (see FIG. 15) unless this has already been done. Next, the inclination of backstop unit 42 is adjusted by increasing or decreasing the length of strut 52 as discussed above. The practice device is then ready for use with the exception that, if pitching is being practiced, the user may wish to relocate the cord 68 outlining the strike zone.

Figure 27:
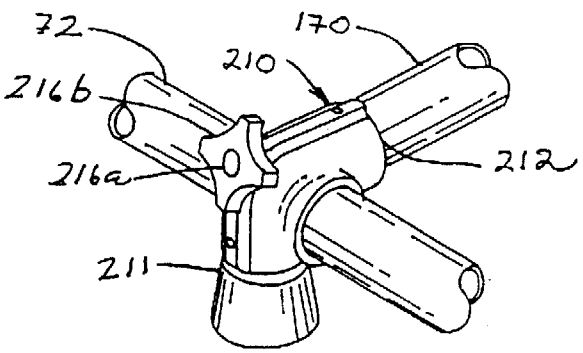
FIG. 27 is a view similar to FIG. 9, of a universal fitting which functions both a backstop unit-supporting foot and a support-to backstop unit-connector and can replace the separate components employed in the FIG. 1 practice device for these two different purposes.

FIG. 27 depicts an L-shaped dual function fitting 210 which can be incorporated in practice devices embodying the principles of the present invention. This fitting has a foot 211 and replaces the foot-providing fittings 78 and 79 shown in FIGS. 1–3. Also, it has a socket 212 into which the ends of the longitudinally extending legs 168 and 170 of ground-engaging, U-shaped bracket 48 can be fitted. This makes unnecessary the fittings 214 and 216 (see FIGS. 4, 5, and 6) employed in practice device 40 to couple bracket 48 to the frame 64 of backstop unit 42. Fitting 210 is clamped to bottom rail 72 of backstop unit frame 64 with a fastener 216*a* which is threaded through the fitting and rotated with a knob 216*b*.

Figure 28:
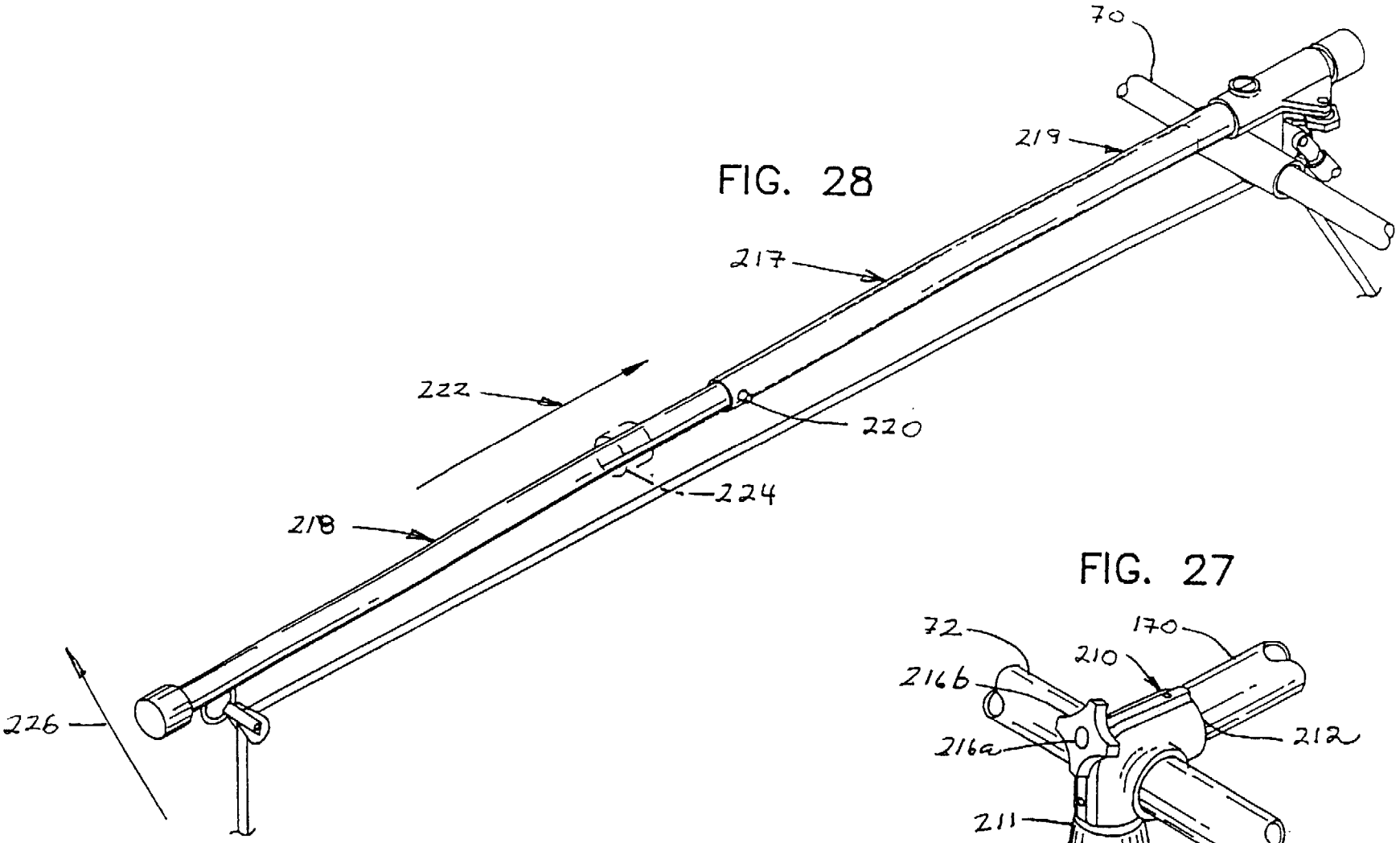
FIG. 28 is a fragmentary, perspective view of a practice device as shown in FIG. 1 but equipped with the FIG. 27 fitting and a telescopable, cantilevered arm which eliminates the necessity of displacing that arm in the fitting when the practice device is erected for use and collapsed for storage and/or for rolling movement from one location to another.

FIG. 28 illustrates a second type of ball-supporting, cantilevered arm 217 which can be substituted for the arm 83 described above. Arm 217 is composed of two, elongated, telescoping components 218 and 219. Depressing a spring-loaded button 220 allows component 218 to be displaced in the arrow 222 direction to house that component in companion element 219 arm as indicated by reference character 224. With support arm 217 thus collapsed and swung to the side as shown by arrow 226 in FIG. 28, the stowage of arm 217 is completed. This eliminates the above-discussed step of sliding the arm through its supporting fitting so that the stowed arm will not extend beyond the side margins of backstop unit 42.

It is believed that the nature and use of practice device 40 will be apparent from the drawings and the foregoing text to those versed in the arts to which the present invention relates. Nevertheless, to insure that this is the case, further details of the practice device are provided below.

In particular, it was pointed out above that backstop unit 42 includes a rectangular frame 64 and a net 66. As shown in FIG. 1, net 66 is surrounded by frame 64. The net is attached to the frame with fasteners 228 spaced at generally equal intervals around frame 64. The fasteners 228 are identical. Each includes an elastic cord 230 with ends (not shown) fastened in a ball-like fitting 232. A filament 67 at the periphery of net 66 is trapped against one of the four rails 70 . . . 76 by stretching cord 230 around the filament and the rail with a loop 234 at the end of cord 230 opposite fitting 232 then being trained over that component and released to complete the process. Elastic cord fasteners 228 do not have to be employed, but have the advantage that they allow net 66 to be readily removed and replaced, as necessary.

Figure 7:
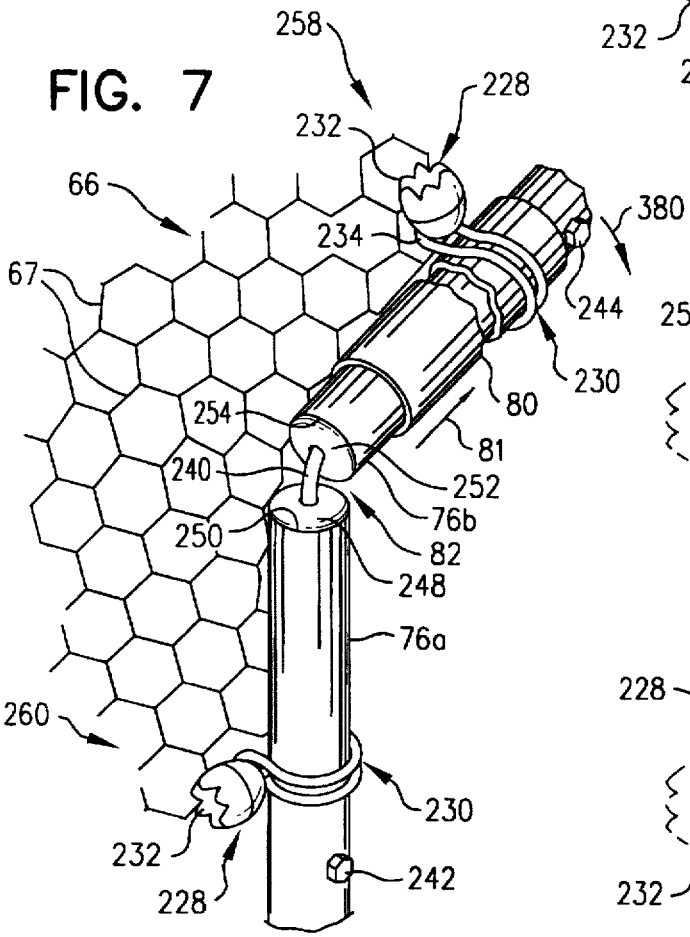
FIG. 7 is a fragmentary view of the FIG. 1 practice device showing one of two sleeve-and-cord connector arrangements at opposite sides of the device; these connectors allow vertical standards of the practice device backstop unit to be broken down in the course of reconfiguring the practice device for storage and/or for movement from one location to another.
Figure 8:
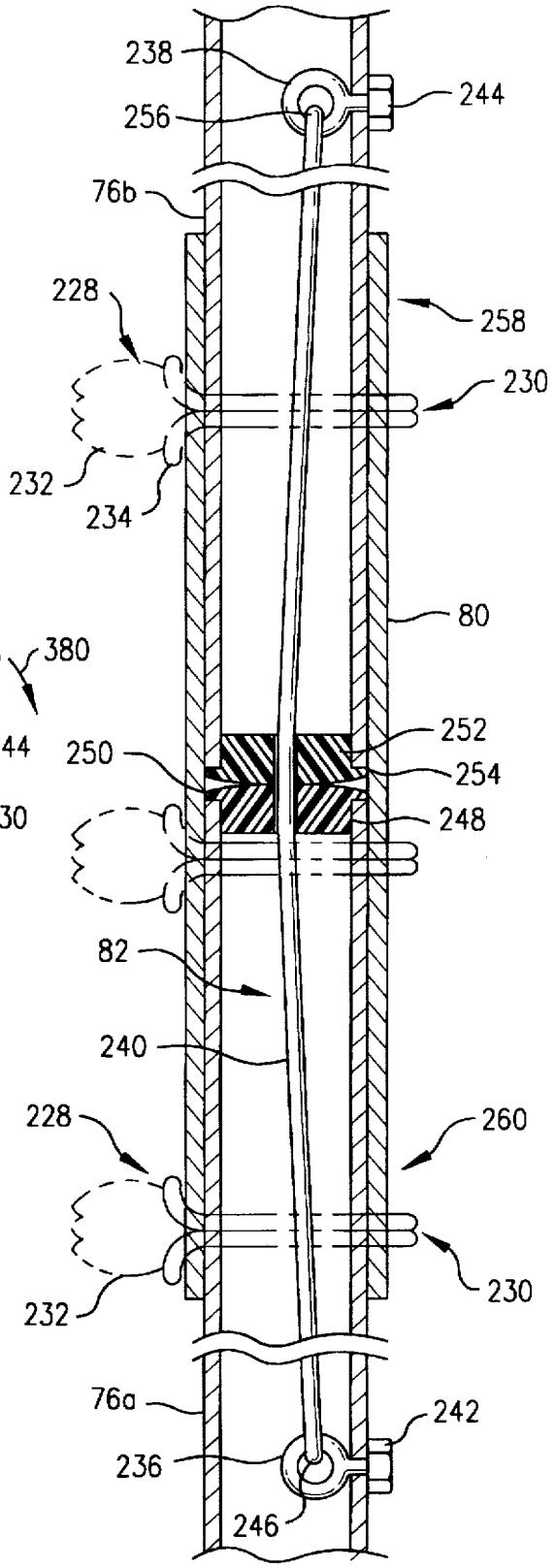
FIG. 8 is a section through the vertical standard shown in disassembled form in FIG. 7; this figure shows how the sleeve of the connecting arrangement holds upper and lower sections of the standard together in vertically aligned relationship as well as a flexible cord which keeps the two sections together when the standard is disassembled.

Referring now to FIGS. 7 and 8, the bungee cord connector systems 82 for the backstop frame side rails 74 and 76 are identical. The illustrated connector system for side rail 76 includes eye bolts 236 and 238 and an elastic connector such as the illustrated bungee cord 240. Eye bolt 236 is installed in lower side rail component 76*a* and retained in place by a threaded fastener 242. Eye bolt 238 is similarly retained inside upper side rail section 76*b* by a threaded retainer 244. Bungee cord 240 is fastened at its lower end 246 to eye bolt 236. The bungee cord extends from the eye bolt upwardly through tube 76*a*, a cap 248 at the upper end 250 of tube 76*a*, and a cap 252 at the lower end 254 of upper tubular component 76*b*, and is fastened at its upper end 256 to eye bolt 238. As discussed above, and as is best shown in FIG. 7, bungee cord connector systems 82 allow backstop unit 42 to be broken down and folded in half for storage (see also FIGS. 16 and 17) while keeping the two, upper and lower backstop unit sections 258 and 260 together in an easily handled relationship when this is done.

Turning now to FIGS. 9 and 10, it was pointed out above that the cantilevered, ball-supporting arm 83 is mounted in a fitting 84. That fitting includes castings 261, 262, and 264. Casting 261 has a downwardly extending barrel 266; parallel, integral brackets 268 and 270 extending normally from barrel 266; and transversely extending barrel 272. The top rail 70 of backstop unit frame 64 extends through the barrel 272 of casting 261. Fasteners 274 (one shown in FIG. 9) are threaded through barrel 272 and top rail 70 to lock fitting 84 to that rail as shown in FIG. 10.

Casting or fitting component 262 has a vertical barrel 276 and a horizontal barrel 278. Barrel 276 is rotatably seated in the vertical barrel 266 of frame-associated casting 261 with a polymeric sleeve bearing 279 and a polymeric washer 280 being installed between the two castings so that casting 262 can rotate freely in casting 261.

The cantilevered support arm 83 for ball-suspension system 44 is housed between casting 262 and casting 264, which have complementary, semicircular arm-receiving annuli 282 and 284. These two castings are clamped together by a fastener 286 which extends through integral flanges 288 and 290 of these castings and a retainer 292 threaded onto the lower end of fastener 286.

Referring still to FIGS. 9 and 10, both the pulley 120 of ball-suspension system 44 and the supporting strut 52 for backstop unit 42 are mounted to fitting 84. In particular, strut 52 includes a clevis 296 at the upper end of the strut's upper tubular component 158. Clevis 296 is detachably fixed to tube 158 so that strut 52 can be removed in the course of configuring practice device 40 as a cart. Specifically, the clevis 296 and strut 52 are connected by a pin 298 which extends through a hole 299 in the upper end 300 of strut component 158 and an aligned hole 301 through the shank 302 of clevis 296 as indicated by the broken line 304 in FIG. 9. To keep this pin from being lost, it is preferably connected by the illustrated handle 306, ring 308, and lanyard 310 to the clevis.

At its upper end, clevis 296 is pivotally connected to the casting 261 of fitting 84 by a pivot pin 311. That pin extends seriatim through the arm 312 of clevis 296, the clevis mounting brackets 268 and 270 of fitting 261, and a second arm 313 of the clevis. Pin 311 is retained by a hand manipulatable knob 314 threaded on the free end of the fastener; i.e., the end opposite head 316. Tightening knob 314 clamps the arms 312 and 313 of clevis 296 against mounting flanges 268 and 270 to provide a rigid connection between strut 52 and backstop frame 64.

As is perhaps best shown in FIG. 10, pulley 120 includes a support ring 318 captured in the eye 320 of a conventional eye bolt 322. The shank 324 of the eye bolt is threaded through the bottom 326 of casting 262 and secured against rotation by a lock washer 328. Pulley 120 is thereby securely fixed to fitting 84, at the same time retaining sufficient play to accommodate the movement of the bungee cord 104 trained through that pulley.

Figure 19:
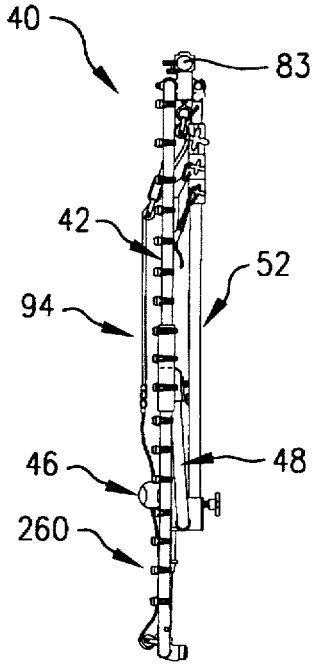
FIG. 19 is a side view of the practice device in the storage configuration.
Figure 20:
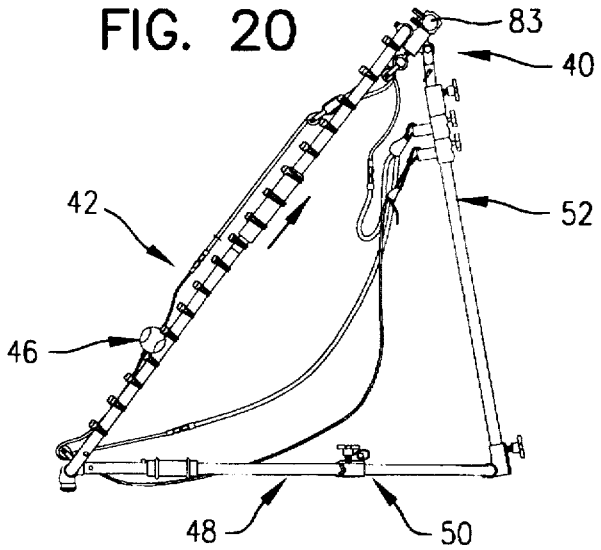
FIG. 20 is a view similar to FIG. 15 in which the telescopable, backstop-supporting strut has been collapsed as shown in that figure and the ball-supporting, cantilevered arm has been swung to the side and displaced through the FIG. 10 fitting as shown in FIG. 16 so that the arm will not protrude the margins of the backstop unit; these are the initial steps in configuring the FIG. 1 practice device so that the device can be wheeled from one location to another.

Referring now to FIGS. 1–4, the use of tubular clamps and threaded fasteners with hand-manipulatable knobs as just described is employed throughout practice device 40 to couple together components of that device. Thus, longitudinally extending legs 330 and 332 of surface engaging support 50 are installed in clamps 334 and 336. Each of these clamps includes a component 338 through which the transverse leg 154 of surface engaging support 48 extends and a component 342 threaded through the associated component 338 and tightened against support leg 154 by a knob 344. That locks support 50 to support 48 in a backstop unit-supporting relationship as shown in FIGS. 1–4 or in a folded relationship as shown in FIG. 19 when practice device 40 is stowed.

Similar clamps or fittings are employed to support the pulley 122 and ratchet or one-way clutches 132 and 140 of ball suspension system 44 and to lock the upper and lower components 158 and 160 of collapsible strut 52 together. These clamps are referred to above and identified by reference characters 123, 134, and 161.

All three of these clamps are mounted on and slidable along the lower component 160 of strut 52. Like the clamps 334 and 366 discussed above, those identified by reference characters 161, 123, and 124 each have a main body component 338, a fastener component 342 threaded through the associated component 338, and a hand-manipulatable knob 344 for locking the clamp to the component on which it is mounted, in this case the lower component 160 of collapsible strut 52.

As discussed above, clamp 161 allows the length of strut 52 to be adjusted to hold backstop unit 42 at the wanted angle with respect to the surface on which practice device 40 is located. Clamps 123 and 134 allow pulley 120 and the two ratchets 138 and 140 can be adjusted to levels providing optimum performance of elastic damping unit 94.

Yet another clamp of the character just described is employed to couple the lower end of strut 52 to the ground supporting component 50 of practice device 40. This clamp, also shown in FIGS. 1–4, is mounted on the transverse leg 162 of support 50 and is identified by reference character 164 as mentioned previously. This clamp includes a component 354 through which the support leg extends and to which the lower end of strut component 160 is attached along with a screw-like component 356 threaded through clamp component 354 and a knob 358 for locking clamp component 354 to strut element 160.

Referring now to FIGS. 5 and 6, it was pointed out above that the wheels 58 and 60 of practice device 40 are supported from the U-shaped ground-engaging component 48 of practice device 40 by tubular fittings 172 and 174 and that these fittings are slideably mounted on longitudinally extending legs 168 and 170 of the support. In particular, each of these wheels is mounted between the depending flanges 360 and 362 of a wheel-supporting bracket 364 on an axle 366 mounted at its opposite ends to flanges 360 and 362. Bracket 364 also has a horizontally oriented, plate-like element 368 to which wheel-supporting flanges 360 and 362 are attached at their upper ends. Each of the two brackets 364 is mounted to the associated fitting 172 or 174 by: (a) U-bolts 370 and 372 which extend through bosses 374*a–d* on element 368; and (b) four fasteners 376, which clamp fittings 172 and 174 between wheel supporting bracket 364 and U-bolt clamps 370/372.

Figure 14:
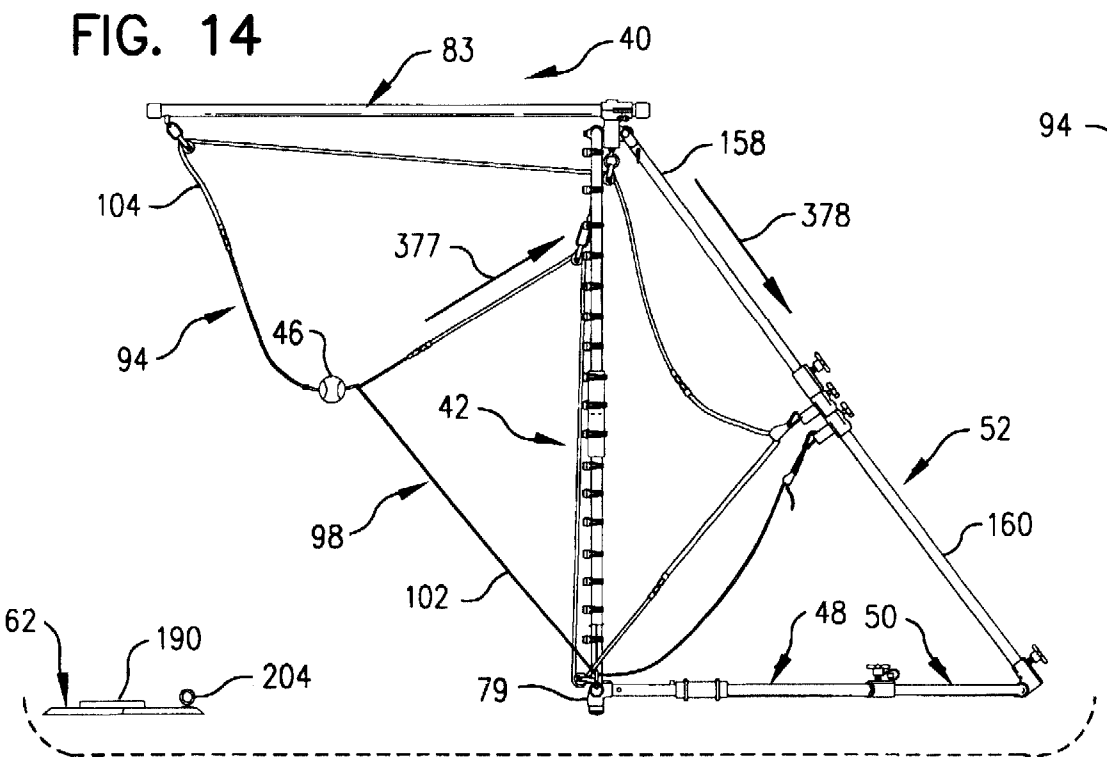

Referring now to FIGS. 14–19, the erected practice device 40 (see FIG. 1) is reconfigured into a compact package for storage by first unhooking fitting 127 from home plate 62, displacing it in the arrow 377 direction, and then attaching the fitting to net 66 toward the upper margin of that practice device component (FIG. 14). Then, clamp 161 is loosened and strut 52 is collapsed as indicated by arrow 378 in the same figure. Next, the cantilevered support arm 83 for ball suspension system 44 is rotated 90 degrees as shown by arrow 379 (FIGS. 15 and 16) and slid through fitting 262 (FIG. 16) until the arm lies along the top rail 70 of backstop frame 64 (FIG. 17) as indicating by arrow 166. Then, sleeves 80 (FIGS. 7 and 8) are slid upwardly until the upper ends of lower backstop frame side rail components 74*a* and 76*a* are cleared; and the upper half 258 of the backstop unit is folded as suggested by arrow 380 in FIG. 7 until that half of the backstop unit lies against the lower half 260 of the unit (FIGS. 16 and 17). Next, clamps 334 and 336 are loosened; and: (1) surface engaging support component 48 is folded against backstop frame 64; and (2) ground engaging component 50 is folded against component 48 (FIG. 18), also collapsing strut 52 against the backstop frame (FIG. 19) as indicated by arrow 379*a* in FIG. 18.

To erect practice device 40; i.e., to reconfigure it from the compact, stowable package shown in FIG. 19 to the operating configuration shown in FIG. 1, the steps just described are essentially reversed.

Figure 21:
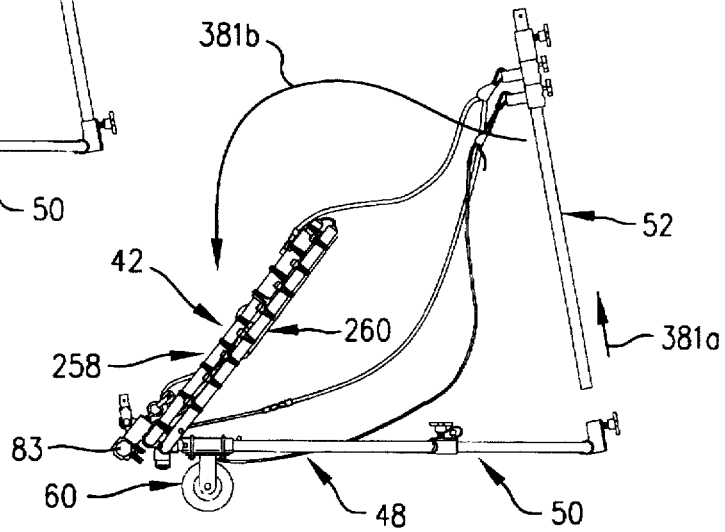
FIG. 21 is a view similar to FIG. 20 but with: (a) the vertical standards of the backstop unit framework disconnected as shown in FIG. 7; (b) the backstop unit subsequently folded up as shown in FIG. 16; (c) the telescopable, backstop unit-supporting strut of the practice device removed; and (d) the wheels of the practice device lowered as shown in FIG. 6 so that the practice device can be rolled from one location to another.

As discussed above, practice device 40 may also be reconfigured as a cart, rolled to a storage location, and then reconfigured into a compact unit for storage. To configure practice device 40 into a cart, ball suspension system 44 is unhooked from home plate 62 and stowed as discussed above. Then, backstop supporting strut 52 is collapsed also as discussed above (FIG. 20). Next (FIG. 21), the upper and lower sections 258 and 260 of backstop unit 44 are disjointed as previously described and folded together (FIG. 21).

Figure 22:
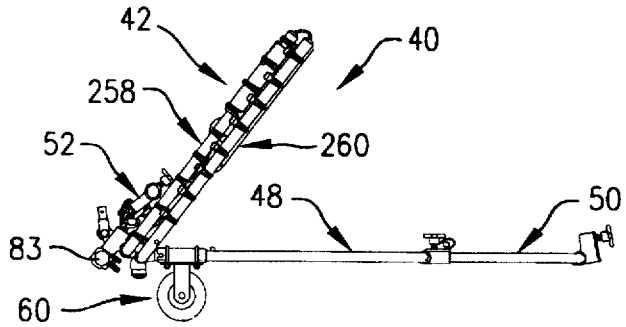
FIG. 22 is a view similar to FIG. 21 but with the backstop unit-supporting strut stored on the folded up backstop unit.
Figure 23:
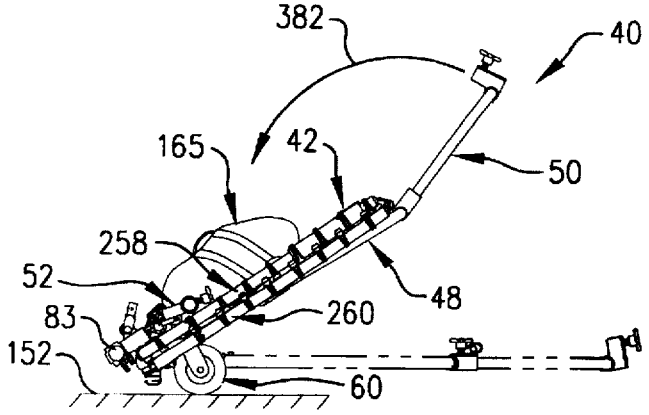
FIG. 23 is a view similar to FIG. 22 but with: (a) the backstop folded against the U-shaped, ground-engaging component of the practice device nearest the backstop unit; (b) the further or rearmost of the ground-engaging, U-shaped components folded slightly toward the near one of those components to function as a handle; and (c) an equipment bag placed on the folded up backstop for transport with the practice device.
Figure 24:
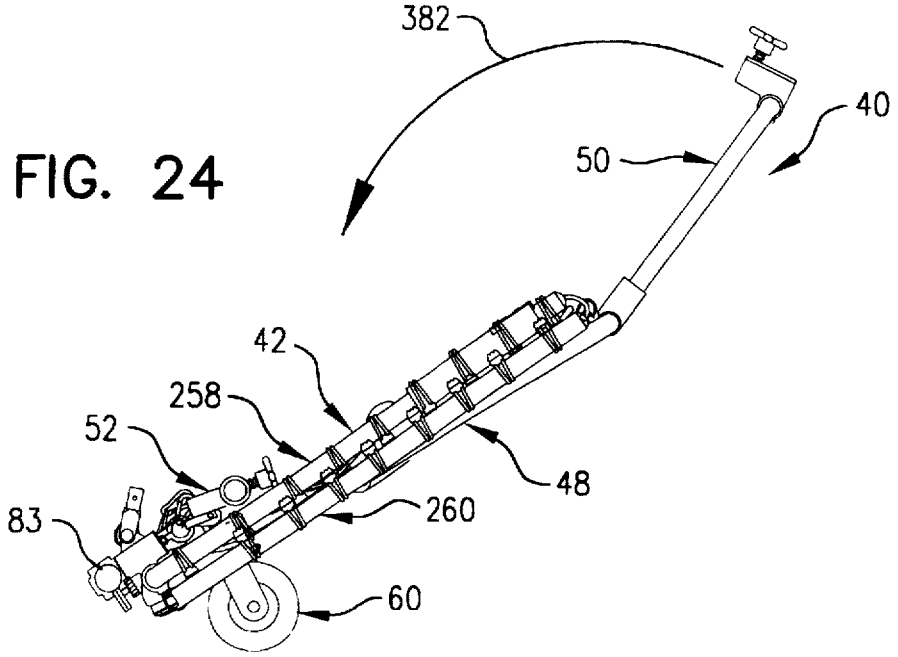
FIG. 24 is a view similar to FIG. 23 but with the dual-function, ground-engaging support and handle component being folded toward the collapsed backstop unit to make the FIG. 1 practice device more compact and thus more easily stored.

As shown in that figure and in FIG. 22, the fastener 356 of T-shaping fitting 164 (FIG. 3) is then loosened by rotating knob 358; and the pin 298 which couples the upper end 300 of strut 52 to clevis 296 is removed. The strut is removed and stowed on the backstop unit as indicated by FIG. 21 arrows 381*a* and 381*b* (FIG. 22). This is followed by collapsing the backstop unit and ground engaging support 48 together in the manner discussed above and adjusting support 50 at an angle to support 48 as suggested by arrow 382 in FIGS. 23 and 24. Support 50 then functions as a handle for pulling the practice device and baggage such as the previously mentioned equipment bag 165.

Once a storage location is reached, support 50 is folded against support 48 and backstop unit 42 in the manner previously discussed. Finally, wheels 58 and 60 are displaced from the wheels down position shown in FIG. 6 to the wheels up position shown in FIG. 5 in the manner discussed above to complete the configuration of the practice device for storage.

Various modifications of practice device 40 have been discussed above. Another modification, shown in FIG. 29, involves a replacement of the above-discussed clamp-type fittings 123, 134, and 161 with the single fitting 384 illustrated in the just-mentioned figure. This fitting has a tubular barrel 386 through which the lower component 160 of backstop unit-supporting strut 52 extends, a fastener (not shown) threaded through barrel 386, and a knob 388 for rotating the threaded fastener until it engages strut component 160 and clamps the latter against upper strut component 158 to lock those two components together.

Fitting 384 also has integral flanges 390 and 392. The pulley 122 of ball suspension system 44 is attached to flange 390 by keeper 394, and the tension adjusting ratchets 132 and 140 of that system are detachably coupled to fitting flange 392 by S-shaped hooks 396 and 398.

Figure 29:
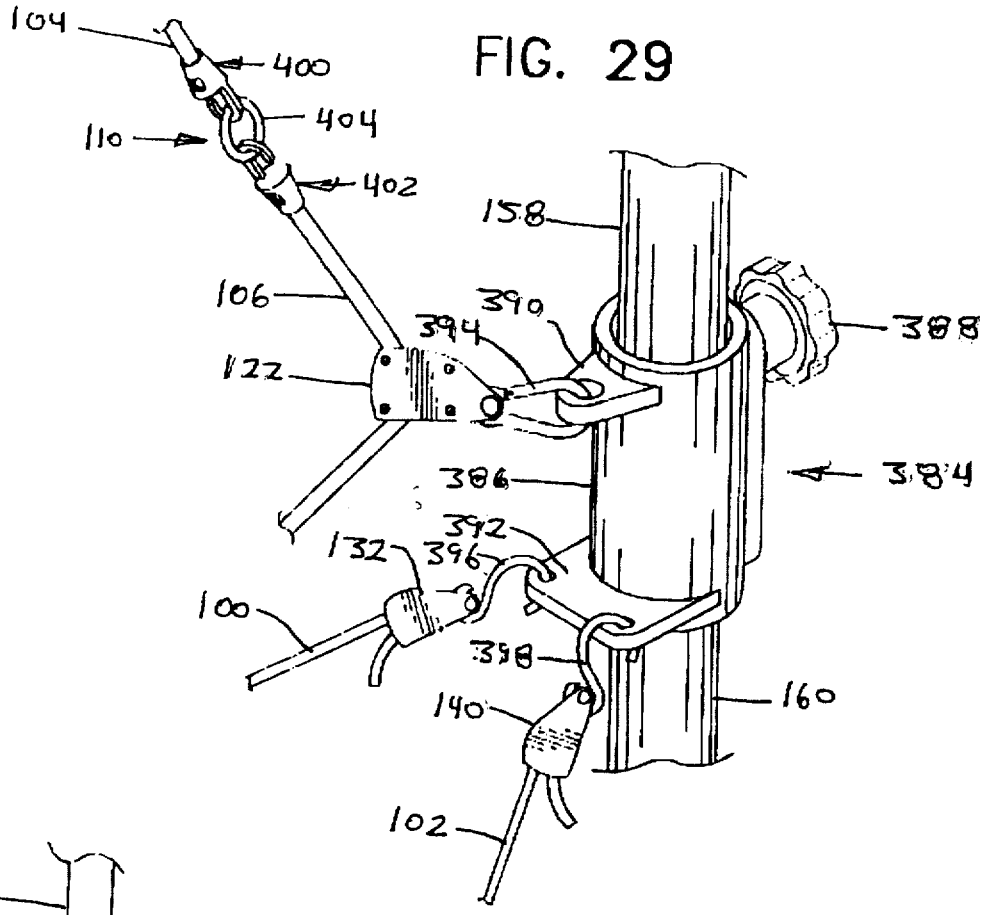
FIG. 29 is a fragmentary view of a practice device of the character shown in FIG. 1 but with a different type of strut-associated suspension system fitting.
Figure 30:
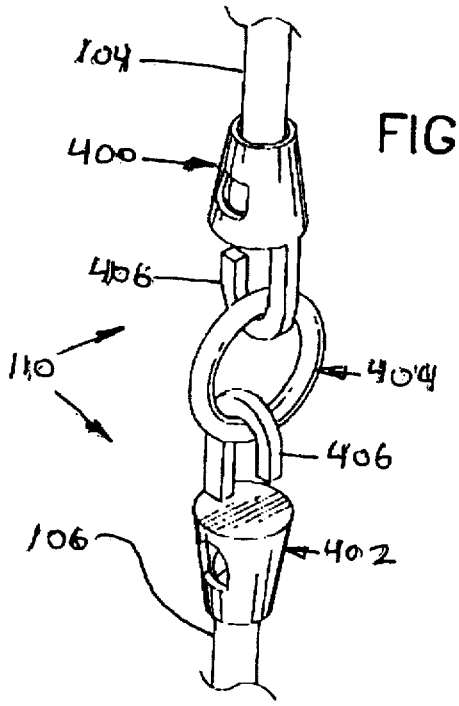
FIG. 30 shows an alternate arrangement for connecting up components of the suspension system.

Yet another modification of device 40 of practical significance is shown in FIG. 29 and in FIG. 30. In device 40, the bungee cords 104, 106, and 108 of elastic damping unit 94 and ball supporting cord 114 are connected up by hooking together those complementary fittings at the apposite ends of those cords which make up connectors 110, 112, 115, and 128. Representative are the bungee cords 104 and 106 and the terminating fittings 400 and 402 of connector 110 shown in FIG. 29. The hooks of those fittings were found to be somewhat susceptible to breakage. This problem is eliminated, in accord with the modification shown in FIG. 30, by separating the fittings with an elastomeric O-ring such as the one identified by reference character 404. The U-shaped hooks 406 of the fittings are snared in the O-ring as shown in FIG. 30. O-ring 404 thus cushions impacts on the elements 406 of fittings 402 and 400, reducing to an inconsequential level the possibility of those elements breaking.

The invention may be embodied in many forms without departing from the spirit or essential characteristics of the invention. The present embodiments are therefore to be considered in all respects as illustrative and not restrictive. The scope of the invention is indicated by the appended claims rather than by the foregoing description, and all changes which come within the meaning and range of equivalency of the claims are therefore intended to be embraced therein.

What is claimed is:

1. A game practice device comprising:

a backstop having vertically extending opposite margins and front and rear sides;

a ball:

a home plate which has side margins and is on the front side of said backstop; and means for suspending said ball above said home plate in a strike zone defined by the side margins of said home plate, said ball suspending means comprising means for damping motions of the ball as said ball returns to a rest position after having been struck;

said damping means comprising a damping means assembly of vertically spaced, elastically extensible segments and a ball supporting element connected between said segments, said ball supporting element extending through said ball and having upper and lower portions;

said ball suspending means further comprising a tether means for tensioning said damping means and a cantilevered arm which has first and second ends and is fixed at said first end to said backstop;

a portion of said damping means assembly being suspended from the second end of said cantilevered arm; and said tether means comprising two inelastic lines both connected at one end thereof to the ball supporting element lower portion below the ball, said lines extending to opposite side margins of the backstop and then to anchor means located on the rear side of said backstop and midway between the side margins of the backstop.

2. A practice device as defined in claim 1 in which the lines of the tether means can be displaced in said anchor means to increase and decrease tension on said damping means.

3. A game practice device comprising:

a ball:

a backstop with upper and lower margins, first and second vertically extending opposite side margins, and front and rear sides;

a home plate which has side margins and is positioned on the front side of said backstop; and means for suspending said ball above said home plate in a strike zone defined by the side margins of said home plate, said ball suspending means comprising means for damping motions of the ball as said ball returns to a rest position after having been struck;

said damping means comprising a damping means assembly having vertically spaced, elastically extensible segments and a ball supporting element connected between said segments, said ball supporting element extending through said ball and having upper and lower portions;

said ball suspending means further comprising a tether means for tensioning said damping means and a cantilevered arm which has first and second ends and is fixed at said first end to said backstop;

a portion of said damping means assembly being suspended from the second end of said cantilevered arm; and said tether means comprising two inelastic lines both connected at one end thereof to the ball supporting element lower portion, said lines extending from said ball supporting element to the first and second vertically extending opposite side margins of the backstop and then to anchor means fixed relative to said backstop at a level between the upper and lower margins of the backstop, said lines being displaceable relative to said backstop when said ball is struck and as the ball returns to said rest position after having been struck.

4. A practice device as defined in claim 3 in which the lines of the tether means can be displaced relative to said anchor means to increase and decrease tension on said damping means assembly.

5. A practice device as defined in claim 3 further comprising a telescopeably extensible strut pivotally fixed to and extending downwardly from an upper margin of said backstop for maintaining said backstop at a user-selected angle relative to a load bearing surface, said anchor means being mounted to said strut.

6. A practice device as defined in claim 5 in which said anchor means is displaceable along said strut to change the level of said anchor means.

7. A game practice device as defined in claim 3 wherein the ball suspending means is adjustable to raise and lower said ball and thereby emulate high and low pitches.

8. A game practice device as defined in claim 3 further comprising means for releasably anchoring said damping means assembly to said home plate at a selected one of plural locations between the side margins of said home plate to emulate pitches over inside and outside portions of the home plate as well as pitches over a middle portion of the plate.

9. A game practice device comprising:

a backstop with spaced apart vertically extending margins;

anchor means and fittings fixed relative to said backstop;

a ball;

a home plate with side margins; and means for suspending said ball above said home plate in a strike zone defined by the side margins of said home plate, said ball suspending means comprising means for damping motions of the ball as said ball returns to a rest position after having been struck;

said damping means comprising a damping means assembly of vertically spaced, elastically extensible segments and a ball supporting element connected between said segments, said ball supporting element extending through said ball and having upper and lower portions;

said ball suspending means further comprising a tether means for tensioning said damping means and a cantilevered arm which has first and second ends and is fixed at said first end to said backstop;

a portion of said damping means assembly being suspended from the second end of said cantilevered arm; and said tether means comprising inelastic lines both connected at one end thereof to the ball supporting element lower portion, said lines extending through side fittings to said anchor means, said inelastic lines being freely displaceable through said fittings when said ball is struck and as said ball returns to its rest position.

10. A practice device as defined in claim 9 in which the lines of the tether means can be displaced in said anchor means to increase and decrease tension said damping means.

11. A practice device as defined in claim 10 in which said fittings are mounted to said backstop toward the lower margin of the backstop.

12. A game practice device comprising:

a backstop with front and rear sides and upper and lower margins;

a ball;

a home plate which has side margins and is on the front side of said backstop; and means for suspending said ball above said home plate in a strike zone defined by the side margins of said home plate, said ball suspending means comprising means for damping motions of the ball as said ball returns to a rest position after having been struck, tether means for tensioning said damping means, and a cantilevered arm which has first and second ends and is fixed at said first end to said backstop;

said damping means comprising a closed loop assembly oriented at a right angle to said backstop and includes vertically spaced, elastically extensible segments and a ball supporting element connected between said segments;

a portion of said closed loop assembly being suspended from the second end of said cantilevered arm; and first and second means for supporting components of said closed loop assembly at first and second, vertically spaced locations from said backstop, said closed loop assembly components being freely displaceable relative to said first and second supporting means; and a third supporting means for said closed loop assembly, said third supporting means being located on the rear side of said backstop and said closed loop assembly comprising a component which is freely displaceable relative to said third supporting means.

13. A practice device as defined in claim 12 in which the level of said third supporting means is adjustable.

14. A practice device as defined in claim 12 which comprises a pivotable strut extending downwardly from an upper margin of said backstop for maintaining said backstop at a user-selected angle relative to a load bearing surface, said third loop assembly supporting means being mounted to said strut.

15. A game practice device comprising:

a backstop;

a ball;

a home plate with side margins; and means for suspending said ball above said home plate in a strike zone defined by the side margins of said home plate, said ball suspending means comprising means for damping motions of the ball as said ball returns to a rest position after having been struck, tether means for tensioning said damping means, and a cantilevered arm which has first and second ends and is pivotally fixed at said first end to said backstop;

said damping means comprising a closed loop assembly oriented at a right angle to said backstop and includes vertically spaced, elastically extensible segments and a ball supporting element connected between said segments; and a portion of said closed loop assembly being suspended from the second end of said cantilevered arm.

16. A game practice device as defined in claim 15 which comprises means for releasably anchoring said closed loop assembly to said home plate at a selected one of plural locations spaced between the side margins of said home plate.

* * * * *